US011634972B2

(12) United States Patent
Giroux et al.

(10) Patent No.: US 11,634,972 B2
(45) Date of Patent: Apr. 25, 2023

(54) CATCHER FOR DROPPED OBJECTS

(71) Applicant: Weatherford Technology Holdings, LLC, Houston, TX (US)

(72) Inventors: Richard Lee Giroux, Bellville, TX (US); Rohit Joshi, Fulshear, TX (US); Joshua Vernon Symms, Cypress, TX (US); Ryan Bacsik, Seattle, WA (US)

(73) Assignee: Weatherford Technology Holdings, LLC, Houston, TX (US)

( * ) Notice: Subject to any disclaimer, the term of this patent is extended or adjusted under 35 U.S.C. 154(b) by 56 days.

(21) Appl. No.: 17/175,574

(22) Filed: Feb. 12, 2021

(65) Prior Publication Data

US 2022/0259946 A1 Aug. 18, 2022

(51) Int. Cl.
*E21B 40/00* (2006.01)
*E21B 17/046* (2006.01)

(52) U.S. Cl.
CPC ..... *E21B 40/001* (2020.05); *E21B 17/046* (2013.01)

(58) Field of Classification Search
CPC ..... E21B 33/16; E21B 33/165; E21B 33/167
See application file for complete search history.

(56) References Cited

U.S. PATENT DOCUMENTS

| | | | |
|---|---|---|---|
| 4,674,569 | A | 6/1987 | Revils et al. |
| 5,472,053 | A | 12/1995 | Sullaway et al. |
| 5,647,434 | A | 7/1997 | Sullaway et al. |
| 6,079,496 | A | 6/2000 | Hirth |
| 6,457,517 | B1 | 10/2002 | Goodson et al. |
| 6,796,377 | B2 | 9/2004 | Butterfield, Jr. et al. |
| 7,182,135 | B2 | 2/2007 | Szarka |
| 8,800,655 | B1 | 8/2014 | Bailey |
| 9,103,189 | B2 | 8/2015 | Pacey |
| 9,145,758 | B2 | 9/2015 | King |
| 9,816,351 | B2 | 11/2017 | Lirette et al. |
| 9,856,715 | B2 | 1/2018 | Themig et al. |
| 9,869,157 | B2 | 1/2018 | Sevadjian et al. |
| 10,246,968 | B2 | 4/2019 | Budde et al. |
| 10,533,392 | B2 | 1/2020 | Walton et al. |
| 10,544,655 | B2 | 1/2020 | Churchill |
| 10,641,061 | B2 | 5/2020 | Bowersock et al. |
| 10,648,272 | B2 | 5/2020 | Budde et al. |
| 11,365,600 | B2 * | 6/2022 | Greenlee ..... E21B 33/134 |
| 2013/0105144 | A1 | 5/2013 | Jordan et al. |
| 2015/0330185 | A1 * | 11/2015 | Hughes ..... E21B 34/14 166/318 |
| 2016/0102526 | A1 | 4/2016 | Wind et al. |
| 2016/0130906 | A1 | 5/2016 | Garvey et al. |
| 2016/0265302 | A1 | 9/2016 | Acosta et al. |
| 2018/0016864 | A1 | 1/2018 | Parekh et al. |
| 2018/0038193 | A1 * | 2/2018 | Walton ..... E21B 23/06 |
| 2018/0106120 | A1 | 4/2018 | Harris et al. |
| 2019/0352998 | A1 | 11/2019 | Wolf et al. |

OTHER PUBLICATIONS

International Search Report and Written Opinion in related application PCT/US2022/070140 dated Apr. 19, 2022.

* cited by examiner

*Primary Examiner* — David Carroll
(74) *Attorney, Agent, or Firm* — Peter V. Schroeder; Booth Albanesi Schroeder PLLC

(57) ABSTRACT

A catcher for use in a wellbore includes a housing and an insert disposed within the housing. A method of using the catcher includes disintegrating at least a portion of the insert while the insert is held rotationally stationary with respect to the housing by a taper connection between the insert and the housing.

17 Claims, 21 Drawing Sheets

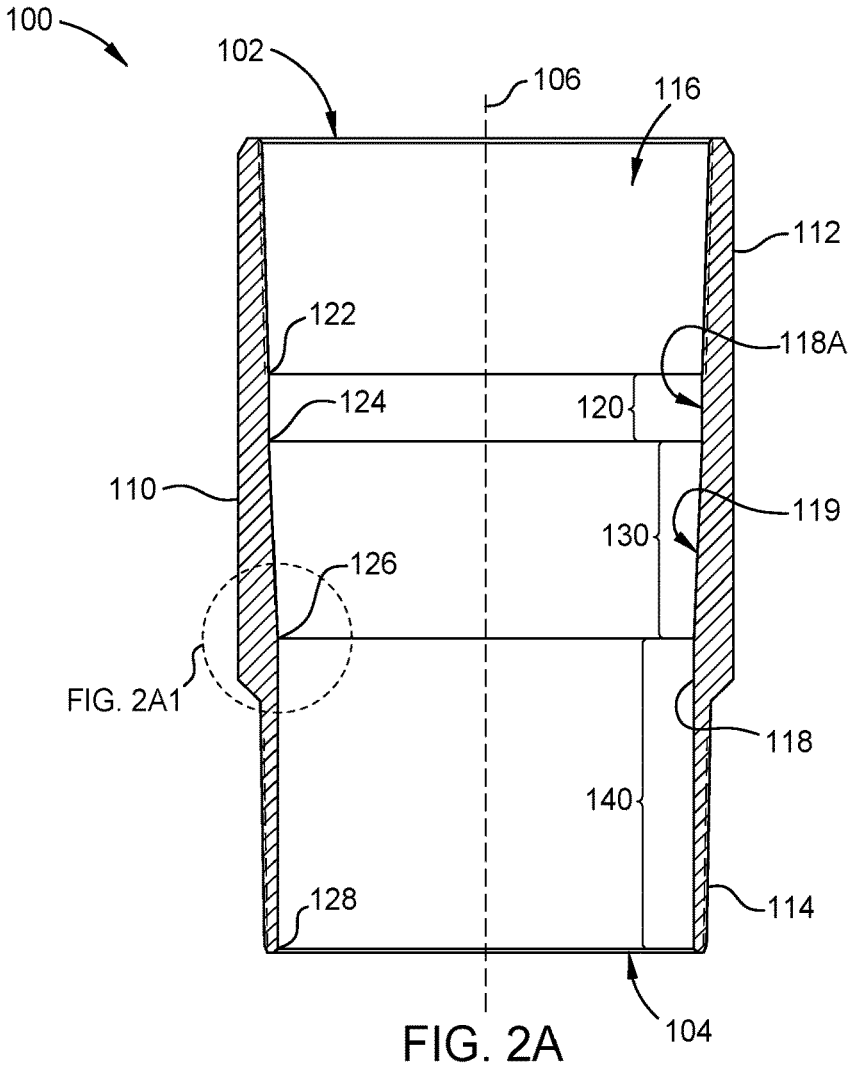
FIG. 2A
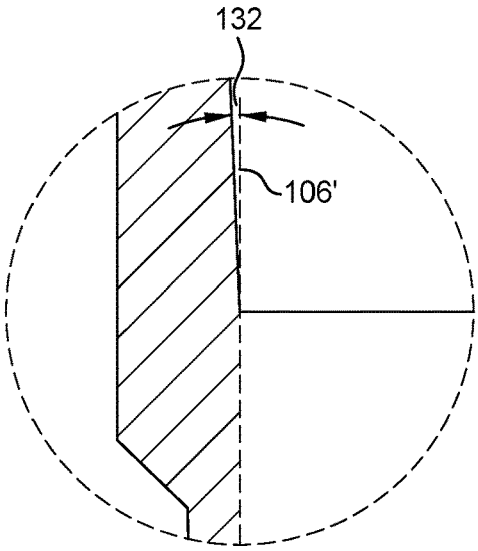
FIG. 2A1

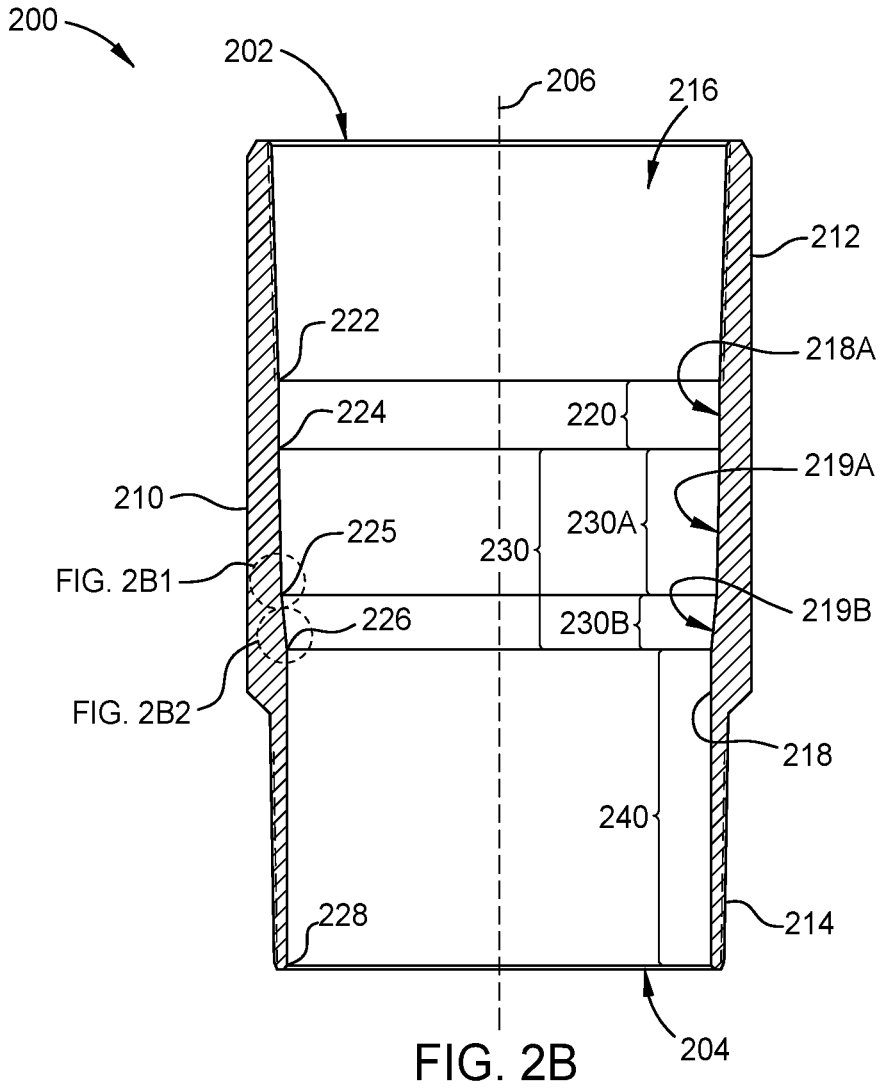
FIG. 2B
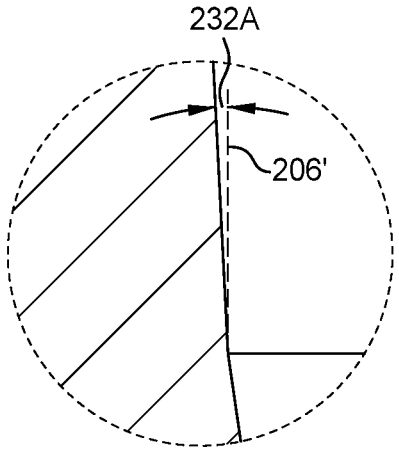
FIG. 2B1
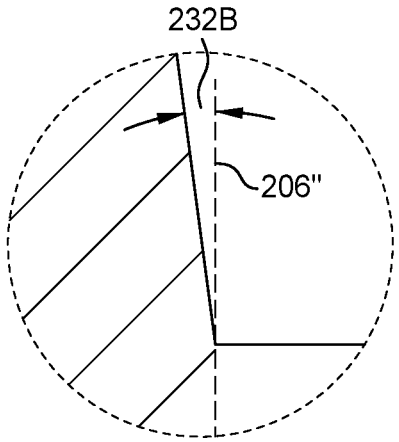
FIG. 2B2

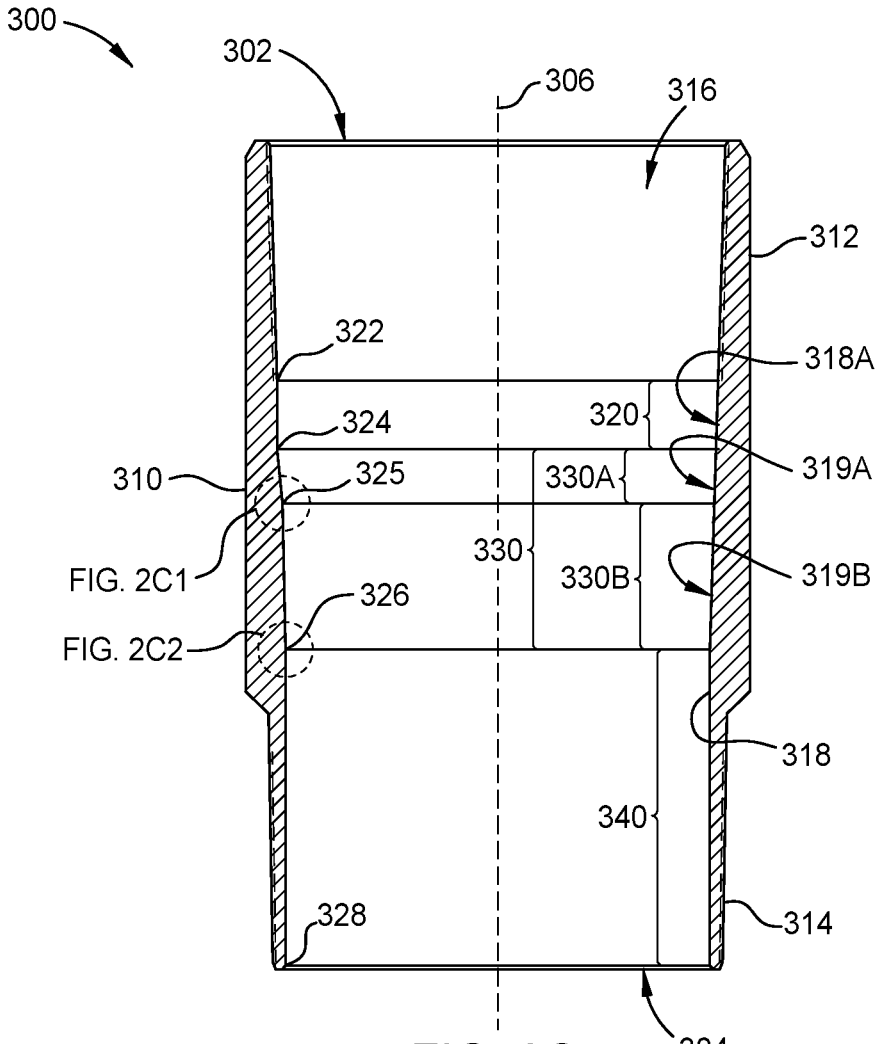
FIG. 2C
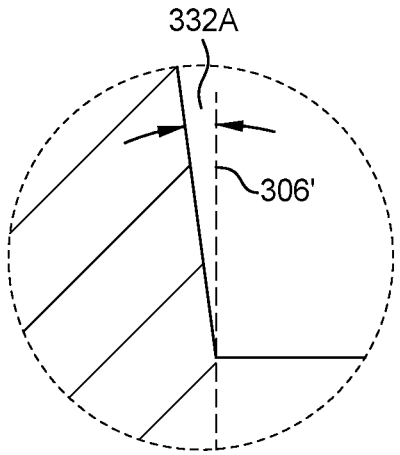
FIG. 2C1
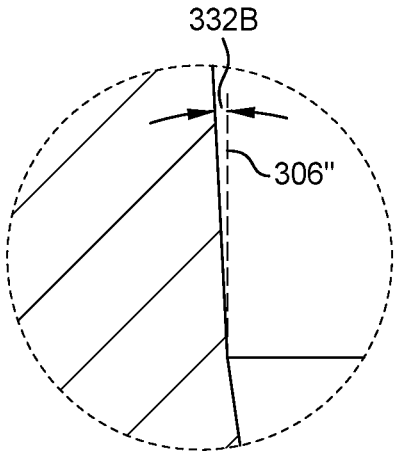
FIG. 2C2

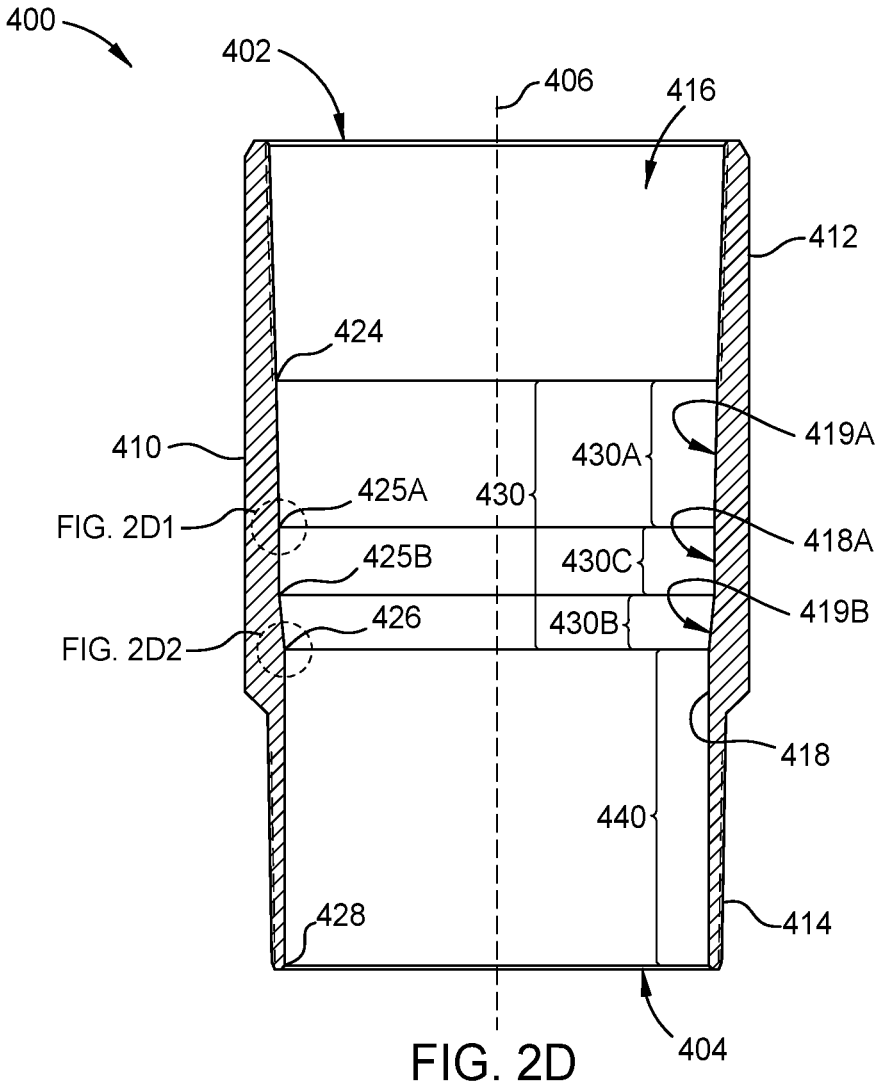
FIG. 2D
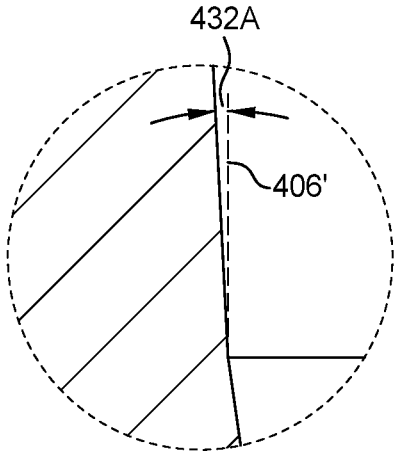
FIG. 2D1
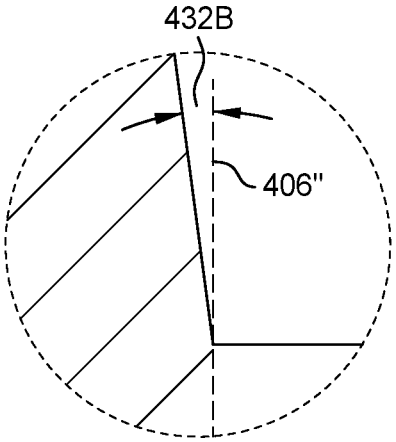
FIG. 2D2

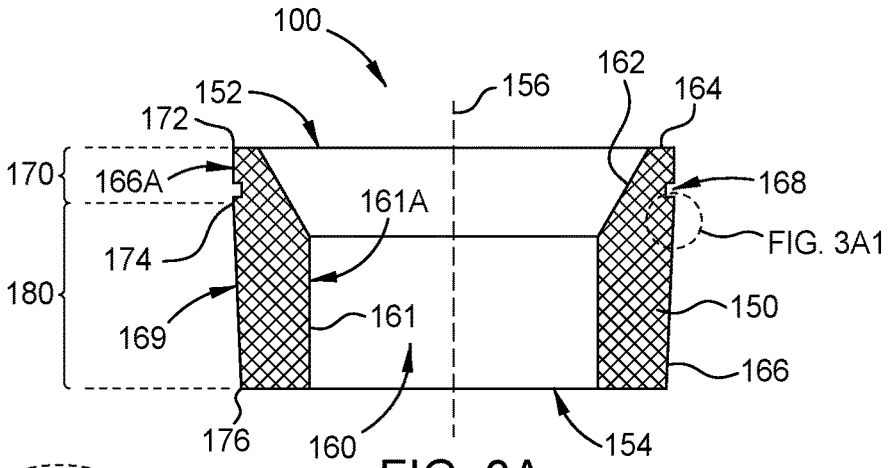
FIG. 3A
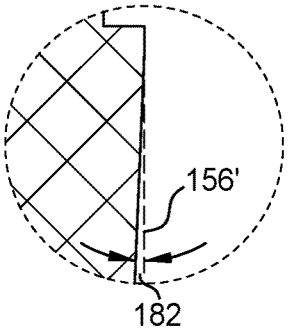
FIG. 3A1
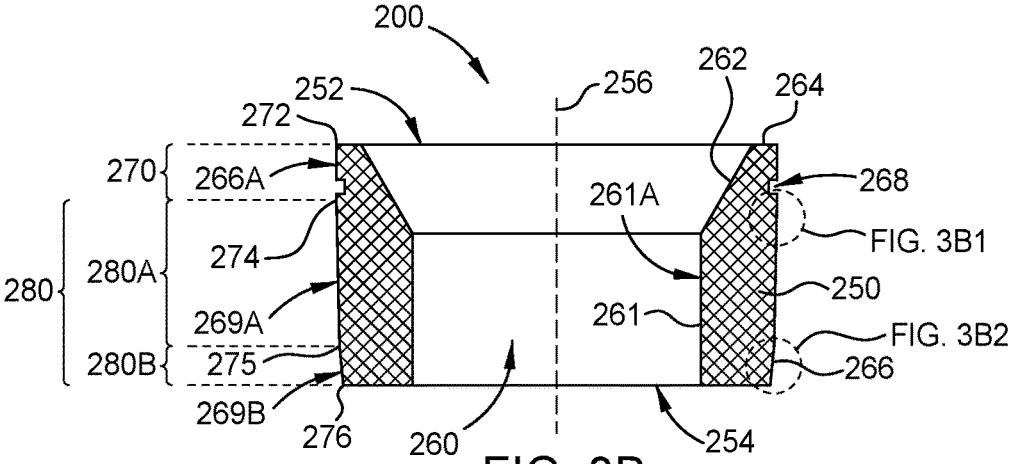
FIG. 3B
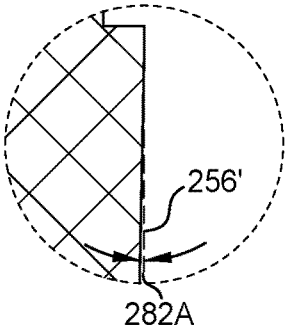
FIG. 3B1
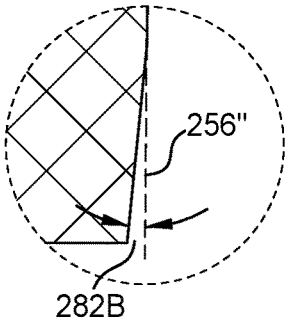
FIG. 3B2

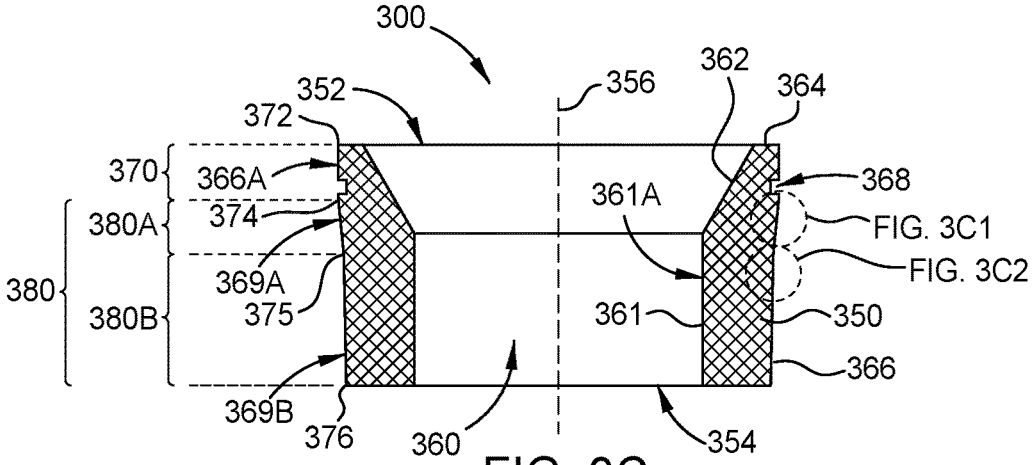
FIG. 3C
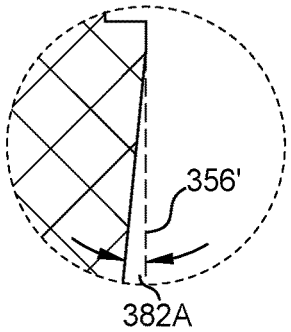
FIG. 3C1
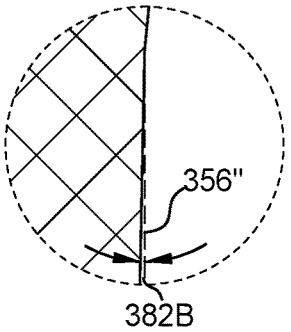
FIG. 3C2
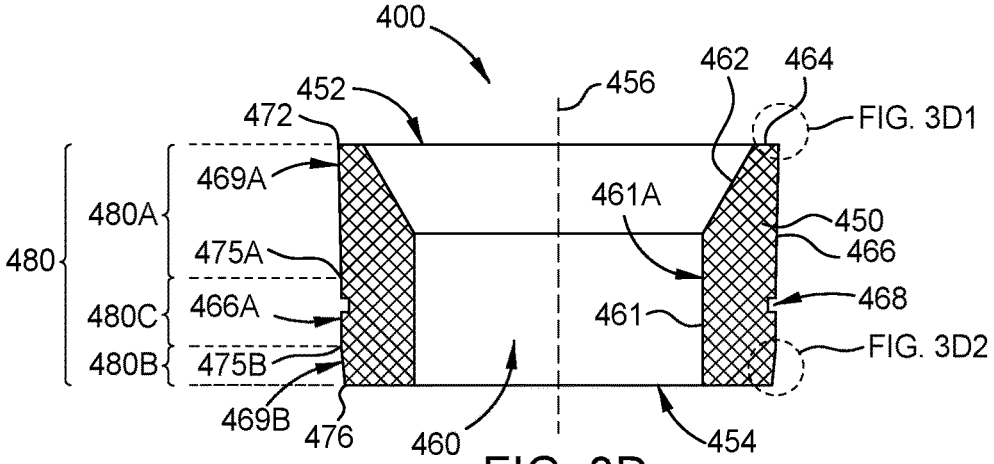
FIG. 3D
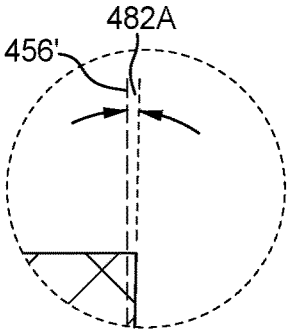
FIG. 3D1
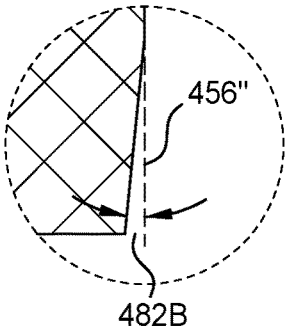
FIG. 3D2

CATCHER FOR DROPPED OBJECTS

BACKGROUND

Field

Embodiments of the present disclosure generally relate to oilfield equipment for use during well construction, and particularly relate to equipment that is installed in a wellbore for catching and/or slowing the passage of a dropped object, such as a ball, cone, dart, or plug.

Description of the Related Art

Typically, during construction of a wellbore, a bore is drilled in the earth's surface, and at least a portion of the drilled bore is lined with tubulars, commonly referred to as casing and/or liners. The term "casing" is used herein to refer to any such tubulars. The casing has an outer diameter that is smaller than the diameter of the drilled bore, and so there exists an annulus between the drilled bore and the casing. Usually, this annulus is at least partially filled with cement, which secures the casing in place and serves as a barrier to impede the migration of fluids within this annulus. Sometimes, cement is also placed in an annulus between concentric casing tubulars. Placement of cement into such annuli usually involves the pumping of a cement slurry that is then left to cure.

During cementing, or during other operations, it may be desirable to land a dropped object on a seat of a catcher in the casing in order to facilitate a build-up of pressure. The pressure may serve to operate a tool, such as the opening of a sleeve or the setting of a liner hanger. The dropped object and the catcher may be removed from the casing by a subsequent drilling operation. Such seats have to be strong enough to withstand the forces resulting from the pressure build-up, yet be configured to disintegrate during the subsequent drilling operation. Typically, such seats are made from aluminum. Because the seats of such catchers are expendable and the removal of such seats takes time, there is a need for a low cost catcher having a seat that is robust when subjected to applied pressure, yet readily disintegrates during a drilling operation.

SUMMARY

The present disclosure generally relates to a catcher for use in a wellbore. In one embodiment, a catcher includes a housing having a longitudinal bore with an inner wall including a first taper. The catcher further includes an insert disposed within the housing, the insert having an upper end, a lower end, a bore from the upper end to the lower end, and an outer wall including a second taper engaged with the first taper. The second taper engaged with the first taper forms a self-locking taper connection.

In another embodiment, a catcher includes a metallic housing having a longitudinal bore with an inner wall including a first taper. The catcher further includes a non-metallic insert disposed within the housing, the insert having an outer wall including a second taper engaged with the first taper. The second taper engaged with the first taper forms a self-locking taper connection.

In another embodiment, a method of using a catcher in a wellbore includes disintegrating at least a portion of a non-metallic insert of a catcher within a metallic housing of the catcher while the insert is held rotationally stationary with respect to the housing by a taper connection between the insert and the housing.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, as the disclosure may admit to other equally effective embodiments.

FIG. 2A is a cross-sectional view of a housing of a catcher. FIG. 2A1 illustrates a detail from FIG. 2A.

FIG. 2B is a cross-sectional view of an alternative embodiment of the housing of FIG. 2A. FIGS. 2B1 and 2B2 illustrate certain details from FIG. 2B.

FIG. 2C is a cross-sectional view of another alternative embodiment of the housing of FIG. 2A. FIGS. 2C1 and 2C2 illustrate certain details from FIG. 2C.

FIG. 2D is a cross-sectional view of another alternative embodiment of the housing of FIG. 2A. FIGS. 2D1 and 2D2 illustrate certain details from FIG. 2D.

FIG. 3A is a cross-sectional view of an insert of a catcher. FIG. 3A1 illustrates a detail from FIG. 3A.

FIG. 3B is a cross-sectional view of an alternative embodiment of the insert of FIG. 3A. FIGS. 3B1 and 3B2 illustrate certain details from FIG. 3B.

FIG. 3C is a cross-sectional view of another alternative embodiment of the insert of FIG. 3A. FIGS. 3C1 and 3C2 illustrate certain details from FIG. 3C.

FIG. 3D is a cross-sectional view of another alternative embodiment of the insert of FIG. 3A. FIGS. 3D1 and 3D2 illustrate certain details from FIG. 3D.

To facilitate understanding, identical reference numerals have been used, where possible, to designate identical elements that are common to the figures. It is contemplated that elements and features of one embodiment may be beneficially incorporated in other embodiments without further recitation.

DETAILED DESCRIPTION

The present disclosure concerns a catcher for use in a wellbore. The catcher includes a housing with an insert disposed therein. The insert is robust when subjected to applied pressure and/or compressive loading, yet readily disintegrates when subjected to a drilling and/or dissolution operation.

Figure 1:
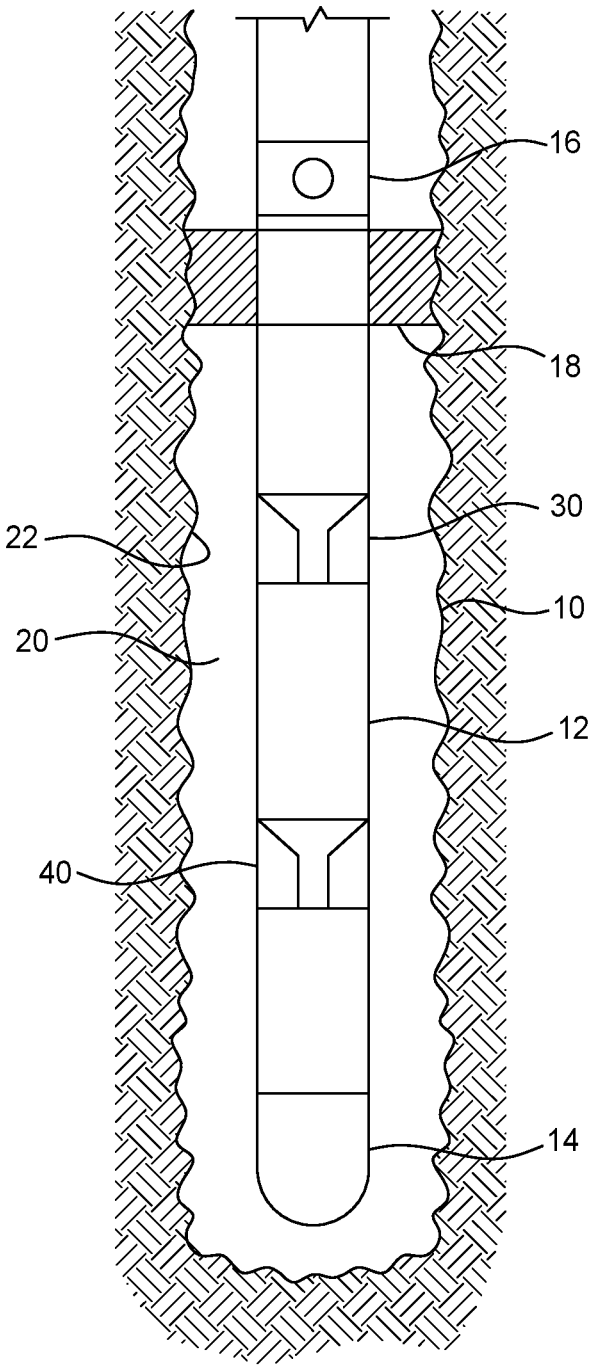
FIG. 1 is a schematic illustration of a casing string, including at least one catcher, in a wellbore.

FIG. 1 is a schematic illustration of a casing string, including at least one catcher, in a wellbore. As illustrated, a casing string 12 in the wellbore 10 includes a shoe 14 at a lower end. The shoe 14 may include valving that permits a cement slurry to be pumped out of the casing string 12, but prevents the cement slurry from entering the casing string 12. The casing string 12 also includes a stage tool 16 and a packer 18. The stage tool 16 provides an additional or alternative route for a cement slurry to be pumped out of the casing string 12. The packer facilitates the sealing of an annulus 20 between the casing string 12 and a wall 22 of the wellbore 10. In some embodiments, it is contemplated that any one or both of the stage tool 16 and/or the packer 18 may be omitted.

The casing string 12 includes a first catcher 30 located below the stage tool 16 and the packer 18. In some embodiments, it is contemplated that the first catcher 30 may be located close to the stage tool 16 and/or the packer 18. For example, the first catcher 30 may be located within 100 feet (30.48 m) of the stage tool 16 and/or the packer 18. The casing string 12 includes a second catcher 40 located below the first catcher 30. In some embodiments, it is contemplated that the second catcher 40 may be located closer to the shoe 14 than the second catcher 40 is to the first catcher 30. In some embodiments, it is contemplated that the second catcher 40 may be located 50 to 1,000 feet (15.24 to 304.8 m) from the shoe 14. Although two catchers 30, 40 are illustrated, in some embodiments, it is contemplated that one of the first catcher 30 or the second catcher 40 may be omitted.

FIG. 2A is a cross-sectional view of a housing 110 of a catcher 100. The catcher 100 may be any of the first catcher 30 and/or the second catcher 40 illustrated in FIG. 1. The housing 110, and hence the catcher 100, has an upper end 102, a lower end 104, and a longitudinal axis 106. At the upper end 102, a top connector 112 facilitates the connection of the catcher 100 to a tubular or a downhole tool. As shown, the top connector 112 is a threaded box configured to mate with a corresponding threaded pin. However, in some embodiments it is contemplated that the top connector 112 may be a threaded pin configured to mate with a corresponding threaded box. At the lower end 104, a bottom connector 114 facilitates the connection of the catcher 100 to a tubular or a downhole tool. As shown, the bottom connector 114 is a threaded pin configured to mate with a corresponding threaded box. However, in some embodiments it is contemplated that the bottom connector 114 may be a threaded box configured to mate with a corresponding threaded pin.

The housing 110 has a longitudinal bore 116 with an inner wall 118 extending from the upper end 102 to the lower end 104. In a first parallel region 120 of the longitudinal bore 116, a portion 118A of the inner wall 118 of the housing 110 extends substantially parallel to the longitudinal axis 106. For example, the portion 118A of the inner wall 118 may extend at angle of less than one degree to the longitudinal axis 106. The first parallel region 120 extends from a parallel start location 122 to a taper start location 124. Of the two locations 122, 124, the parallel start location 122 is closer to the upper end 102. In some embodiments, it is contemplated that the portion 118A of the inner wall 118 at the first parallel region 120 may include a groove, notch, or other surface irregularity configured to receive a locking member, such as a locking ring, tab, dog, collet finger, or the like. In other embodiments, it is contemplated that the portion 118A of the inner wall 118 at the first parallel region 120 may not include a groove, notch, or other surface irregularity. In some embodiments, it is contemplated that the portion 118A of the inner wall 118 at the first parallel region 120 may include a sealing surface against which a sealing member, such as an o-ring, may be received in order to create a seal.

In a tapered region 130 of the longitudinal bore 116, the inner wall 118 of the housing 110 is frustoconical, and includes a taper 119 generally extending at an acute angle 132 to the longitudinal axis 106 from the taper start location 124 to a taper end location 126. For the purpose of illustration, FIG. 2A1 shows the taper 119 extending at acute angle 132 to datum line 106', which is parallel to the longitudinal axis 106. Of the taper start 124 and taper end 126 locations, the taper end location 126 is closer to the lower end 104. The taper 119 is such that an inner diameter of the housing 110 at the taper start location 124 is greater than an inner diameter of the housing 110 at the taper end location 126. In some embodiments, it is contemplated that the internal diameter of the housing 110 at the taper end location 126 may be greater than, or may be substantially equal to, a nominal internal diameter of the casing string 12. In some embodiments, it is contemplated that the inner wall 118 at the tapered region 130 may include a sealing surface against which a sealing member, such as an o-ring, may be received in order to create a seal.

In some embodiments, it is contemplated that the acute angle 132 may be sixty degrees or less, such as fifty degrees or less, forty degrees or less, thirty degrees or less, twenty-five degrees or less, twenty degrees or less, fifteen degrees or less, ten degrees or less, or five degrees or less. In some embodiments, it is contemplated that the acute angle 132 may be sized such that the taper 119 may include a self-locking taper, such as a Morse taper. For example, the acute angle 132 may be from 1.0 degrees to 7.5 degrees, such as 1.5 to 7.0 degrees, 2.0 degrees to 6.5 degrees, 2.5 degrees to 5.0 degrees, 3.0 degrees to 4.5 degrees, or 3.5 degrees to 4.0 degrees. In some embodiments, it is contemplated that the acute angle 132 may be sized such that the taper 119 may include a self-releasing taper, such as an NMTB taper. For example, the acute angle 132 may be 15.5 degrees to 17.5 degrees or greater.

In a second parallel region 140 of the longitudinal bore 116, the inner wall 118 of the housing 110 extends substantially parallel to the longitudinal axis 106, for example, at angle of less than one degree to the longitudinal axis 106. The second parallel region 140 extends from the taper end location 126 to a parallel end location 128. Of the taper end 126 and parallel end 128 locations, the parallel end location 128 is closer to the lower end 104. In some embodiments, as illustrated in FIG. 2A, it is contemplated that the parallel end location 128 may be positioned at the lower end 104. In some embodiments, it is contemplated that the parallel end location 128 may be positioned away from the lower end 104. In some embodiments, it is contemplated that the inner wall 118 at the second parallel region 140 may include a sealing surface against which a sealing member, such as an o-ring, may be received in order to create a seal.

FIG. 2B is a cross-sectional view of a housing 210 of a catcher 200. The catcher 200 may be any of the first catcher 30 and/or the second catcher 40 illustrated in FIG. 1. Elements of the housing 210 of catcher 200 that are equivalent to corresponding elements of housing 110 of catcher 100 are numbered similarly, but starting with 200 instead of 100. The housing 210, and hence the catcher 200, has an upper end 202, a lower end 204, and a longitudinal axis 206. At the upper end 202, a top connector 212 facilitates the connection of the catcher 200 to a tubular or a downhole tool. As shown, the top connector 212 is a threaded box configured to mate with a corresponding threaded pin. However, in some embodiments it is contemplated that the top connector 212 may be a threaded pin configured to mate with a corresponding threaded box. At the lower end 204, a bottom connector 214 facilitates the connection of the catcher 200 to a tubular or a downhole tool. As shown, the bottom connector 214 is a threaded pin configured to mate with a corresponding threaded box. However, in some embodiments it is contemplated that the bottom connector 214 may be a threaded box configured to mate with a corresponding threaded pin.

The housing 210 has a longitudinal bore 216 with an inner wall 218 extending from the upper end 202 to the lower end 204. In a first parallel region 220 of the longitudinal bore 216, a portion 218A of the inner wall 218 of the housing 210 extends substantially parallel to the longitudinal axis 206. For example, the portion 218A of the inner wall 218 may extend at angle of less than one degree to the longitudinal axis 206. The first parallel region 220 extends from a parallel start location 222 to a taper start location 224. Of the two locations 222, 224, the parallel start location 222 is closer to the upper end 202. In some embodiments, it is contemplated that the portion 218A of the inner wall 218 at the first parallel region 220 may include a groove, notch, or other surface irregularity configured to receive a locking member, such as a locking ring, tab, dog, collet finger, or the like. In other embodiments, it is contemplated that the portion 218A of the inner wall 218 at the first parallel region 220 may not include a groove, notch, or other surface irregularity. In some embodiments, it is contemplated that the portion 218A of the inner wall 218 at the first parallel region 220 may include a sealing surface against which a sealing member, such as an o-ring, may be received in order to create a seal.

A tapered region 230 of the longitudinal bore 216 includes first and second portions 230A, 230B, respectively. In the first portion 230A, the inner wall 218 of the housing 210 is frustoconical, and has a taper 219A extending at an acute angle 232A to the longitudinal axis 206 from the taper start location 224 to an intermediate location 225. For the purpose of illustration, FIG. 2B1 shows the taper 219A extending at acute angle 232A to datum line 206', which is parallel to the longitudinal axis 206. Of the taper start 224 and intermediate 225 locations, the intermediate location 225 is closer to the lower end 204. The taper 219A is such that an inner diameter of the housing 210 at the taper start location 224 is greater than an inner diameter of the housing 210 at the intermediate location 225. In the second portion 230B, the inner wall 218 of the housing 210 is frustoconical, and has a taper 219B extending at an acute angle 232B to the longitudinal axis 206 from the intermediate location 225 to a taper end location 226. For the purpose of illustration, FIG. 2B2 shows the taper 219B extending at acute angle 232B to datum line 206", which is parallel to the longitudinal axis 206. The taper 219B is such that the inner diameter of the housing 210 at the intermediate location 225 is greater than an inner diameter of the housing 210 at the taper end location 226. In some embodiments, it is contemplated that the internal diameter of the housing 210 at the taper end location 226 may be greater than, or may be substantially equal to, a nominal internal diameter of the casing string 12. In some embodiments, it is contemplated that the inner wall 218 at the tapered region 230 may include a sealing surface against which a sealing member, such as an o-ring, may be received in order to create a seal.

As illustrated in FIGS. 2B1 and 2B2, acute angle 232B is greater than acute angle 232A. In some embodiments, it is contemplated that any one or more of the acute angles 232A, 232B may be sixty degrees or less, such as fifty degrees or less, forty degrees or less, thirty degrees or less, twenty-five degrees or less, twenty degrees or less, fifteen degrees or less, ten degrees or less, or five degrees or less. In some embodiments, it is contemplated that any one or more of the acute angles 232A, 232B may be sized such that any one or more of the tapers 219A, 219B may include a self-locking taper, such as a Morse taper. For example, any one or more of the acute angles 232A, 232B may be from 1.0 degrees to 7.5 degrees, such as 1.5 to 7.0 degrees, 2.0 degrees to 6.5 degrees, 2.5 degrees to 5.0 degrees, 3.0 degrees to 4.5 degrees, or 3.5 degrees to 4.0 degrees. In some embodiments, it is contemplated that any one or more of the acute angles 232A, 232B may be sized such that any one or more of the tapers 219A, 219B may include a self-releasing taper, such as an NMTB taper. For example, any one or more of the acute angles 232A, 232B may be 15.5 degrees to 17.5 degrees or greater. In some embodiments, it is contemplated that the taper 219A may include a self-locking taper, and the taper 219B may include a self-releasing taper.

In a second parallel region 240 of the longitudinal bore 216, the inner wall 218 of the housing 210 extends substantially parallel to the longitudinal axis 206, for example, at angle of less than one degree to the longitudinal axis 206. The second parallel region 240 extends from the taper end location 226 to a parallel end location 228. Of the taper end 226 and parallel end 228 locations, the parallel end location 228 is closer to the lower end 204. In some embodiments, as illustrated in FIG. 2B, it is contemplated that the parallel end location 228 may be positioned at the lower end 204. In some embodiments, it is contemplated that the parallel end location 228 may be positioned away from the lower end 204. In some embodiments, it is contemplated that the inner wall 218 at the second parallel region 240 may include a sealing surface against which a sealing member, such as an o-ring, may be received in order to create a seal.

FIG. 2C is a cross-sectional view of a housing 310 of a catcher 300. The catcher 300 may be any of the first catcher 30 and/or the second catcher 40 illustrated in FIG. 1. Elements of the housing 310 of catcher 300 that are equivalent to corresponding elements of housing 110 of catcher 100 are numbered similarly, but starting with 300 instead of 100. The housing 310, and hence the catcher 300, has an upper end 302, a lower end 304, and a longitudinal axis 306. At the upper end 302, a top connector 312 facilitates the connection of the catcher 300 to a tubular or a downhole tool. As shown, the top connector 312 is a threaded box configured to mate with a corresponding threaded pin. However, in some embodiments it is contemplated that the top connector 312 may be a threaded pin configured to mate with a corresponding threaded box. At the lower end 304, a bottom connector 314 facilitates the connection of the catcher 300 to a tubular or a downhole tool. As shown, the bottom connector 314 is a threaded pin configured to mate with a corresponding threaded box. However, in some embodiments it is contemplated that the bottom connector 314 may be a threaded box configured to mate with a corresponding threaded pin.

The housing 310 has a longitudinal bore 316 with an inner wall 318 extending from the upper end 302 to the lower end 304. In a first parallel region 320 of the longitudinal bore 316, a portion 318A of the inner wall 318 of the housing 310 extends substantially parallel to the longitudinal axis 306. For example, the portion 318A of the inner wall 318 may extend at angle of less than one degree to the longitudinal axis 306. The first parallel region 320 extends from a parallel start location 322 to a taper start location 324. Of the two locations 322, 324, the parallel start location 322 is closer to the upper end 302. In some embodiments, it is contemplated that the portion 318A of the inner wall 318 at the first parallel region 320 may include a groove, notch, or other surface irregularity configured to receive a locking member, such as a locking ring, tab, dog, collet finger, or the like. In other embodiments, it is contemplated that the portion 318A of the inner wall 318 at the first parallel region 320 may not include a groove, notch, or other surface irregularity. In some embodiments, it is contemplated that the portion 318A of the inner wall 318 at the first parallel region 320 may include a sealing surface against which a sealing member, such as an o-ring, may be received in order to create a seal.

A tapered region 330 of the longitudinal bore 316 includes first and second portions 330A, 330B, respectively. In the first portion 330A, the inner wall 318 of the housing 310 is frustoconical, and has a taper 319A extending at an acute angle 332A to the longitudinal axis 306 from the taper start location 324 to an intermediate location 325. For the purpose of illustration, FIG. 2C1 shows the taper 319A extending at acute angle 332A to datum line 306', which is parallel to the longitudinal axis 306. Of the taper start 324 and intermediate 325 locations, the intermediate location 325 is closer to the lower end 304. The taper 319A is such that an inner diameter of the housing 310 at the taper start location 324 is greater than an inner diameter of the housing 310 at the intermediate location 325. In the second portion 330B, the inner wall 318 of the housing 310 is frustoconical, and has a taper 319B extending at an acute angle 332B to the longitudinal axis 306 from the intermediate location 325 to a taper end location 326. For the purpose of illustration, FIG. 2C2 shows the taper 319B extending at acute angle 332B to datum line 306", which is parallel to the longitudinal axis 306. The taper 319B is such that the inner diameter of the housing 310 at the intermediate location 325 is greater than an inner diameter of the housing 310 at the taper end location 326. In some embodiments, it is contemplated that the internal diameter of the housing 310 at the taper end location 326 may be greater than, or may be substantially equal to, a nominal internal diameter of the casing string 12. In some embodiments, it is contemplated that the inner wall 318 at the tapered region 330 may include a sealing surface against which a sealing member, such as an o-ring, may be received in order to create a seal.

As illustrated in FIGS. 2C1 and 2C2, acute angle 332B is greater than acute angle 332A. In some embodiments, it is contemplated that any one or more of the acute angles 332A, 332B may be sixty degrees or less, such as fifty degrees or less, forty degrees or less, thirty degrees or less, twenty-five degrees or less, twenty degrees or less, fifteen degrees or less, ten degrees or less, or five degrees or less. In some embodiments, it is contemplated that any one or more of the acute angles 332A, 332B may be sized such that any one or more of the tapers 319A, 319B may include a self-locking taper, such as a Morse taper. For example, any one or more of the acute angles 332A, 332B may be from 1.0 degrees to 7.5 degrees, such as 1.5 to 7.0 degrees, 2.0 degrees to 6.5 degrees, 2.5 degrees to 5.0 degrees, 3.0 degrees to 4.5 degrees, or 3.5 degrees to 4.0 degrees. In some embodiments, it is contemplated that any one or more of the acute angles 332A, 332B may be sized such that any one or more of the tapers 319A, 319B may include a self-releasing taper, such as an NMTB taper. For example, any one or more of the acute angles 332A, 332B may be 15.5 degrees to 17.5 degrees or greater. In some embodiments, it is contemplated that the taper 319A may include a self-releasing taper, and the taper 3196 may include a self-locking taper.

In a second parallel region 340 of the longitudinal bore 316, the inner wall 318 of the housing 310 extends substantially parallel to the longitudinal axis 306, for example, at angle of less than one degree to the longitudinal axis 306. The second parallel region 340 extends from the taper end location 326 to a parallel end location 328. Of the taper end 326 and parallel end 328 locations, the parallel end location 328 is closer to the lower end 304. In some embodiments, as illustrated in FIG. 2C, it is contemplated that the parallel end location 328 may be positioned at the lower end 304. In some embodiments, it is contemplated that the parallel end location 328 may be positioned away from the lower end 304. In some embodiments, it is contemplated that the inner wall 318 at the second parallel region 340 may include a sealing surface against which a sealing member, such as an o-ring, may be received in order to create a seal.

In any of the embodiments described with respect to FIGS. 2A to 2C2, it is contemplated that any one of the first parallel region 120, 220, 320 and/or the second parallel region 140, 240, 340 may be omitted.

FIG. 2D is a cross-sectional view of a housing 410 of a catcher 400. The catcher 400 may be any of the first catcher 30 and/or the second catcher 40 illustrated in FIG. 1. Elements of the housing 410 of catcher 400 that are equivalent to corresponding elements of housing 110 of catcher 100 are numbered similarly, but starting with 400 instead of 100. The housing 410, and hence the catcher 400, has an upper end 402, a lower end 404, and a longitudinal axis 406. At the upper end 402, a top connector 412 facilitates the connection of the catcher 400 to a tubular or a downhole tool. As shown, the top connector 412 is a threaded box configured to mate with a corresponding threaded pin. However, in some embodiments it is contemplated that the top connector 412 may be a threaded pin configured to mate with a corresponding threaded box. At the lower end 404, a bottom connector 414 facilitates the connection of the catcher 400 to a tubular or a downhole tool. As shown, the bottom connector 414 is a threaded pin configured to mate with a corresponding threaded box. However, in some embodiments it is contemplated that the bottom connector 414 may be a threaded box configured to mate with a corresponding threaded pin.

The housing 410 has a longitudinal bore 416 with an inner wall 418 extending from the upper end 402 to the lower end 404. In FIG. 2D, a first parallel region of the longitudinal bore 416 equivalent in location to any one of the first parallel regions 120, 220, 320 is omitted. However, in some embodiments it is contemplated that the housing 410 may include a first parallel region equivalent in location to any one of the first parallel regions 120, 220, 320.

A tapered region 430 of the longitudinal bore 416 includes first, second, and third portions 430A, 430B, 430C, respectively. The third portion 430C is located between the first 430A and second 430B portions.

In the first portion 430A of the tapered region 430, the inner wall 418 of the housing 410 is frustoconical, and has a taper 419A extending at an acute angle 432A to the longitudinal axis 406 from a taper start location 424 to a first intermediate location 425A. For the purpose of illustration, FIG. 2D1 shows the taper 419A extending at acute angle 432A to datum line 406', which is parallel to the longitudinal axis 406. Of the taper start 424 and first intermediate 425A locations, the first intermediate location 425A is closer to the lower end 404. The taper 419A is such that an inner diameter of the housing 410 at the taper start location 424 is greater than an inner diameter of the housing 410 at the first intermediate location 425A. In some embodiments, it is contemplated that the internal diameter of the housing 410 at the first intermediate location 425A may be greater than, or may be substantially equal to, a nominal internal diameter of the casing string 12. In some embodiments, it is contemplated that the taper 419A may include a sealing surface against which a sealing member, such as an o-ring, may be received in order to create a seal.

In the second portion 430B of the tapered region 430, the inner wall 418 of the housing 410 is frustoconical, and has a taper 419B extending at an acute angle 432B to the longitudinal axis 406 from a second intermediate location 425B to a taper end location 426. For the purpose of illustration, FIG. 2D2 shows the taper 419B extending at acute angle 432B to datum line 406", which is parallel to the longitudinal axis 406. Of the taper end 426 and second intermediate 425B locations, the taper end location 426 is closer to the lower end 404. The taper 419B is such that an inner diameter of the housing 410 at the second intermediate location 425B is greater than an inner diameter of the housing 410 at the taper end location 426. In some embodiments, it is contemplated that the internal diameter of the housing 410 at the taper end location 426 may be greater than, or may be substantially equal to, a nominal internal diameter of the casing string 12. In some embodiments, it is contemplated that the taper 419BA may include a sealing surface against which a sealing member, such as an o-ring, may be received in order to create a seal.

In some embodiments, it is contemplated that any one or more of the acute angles 432A, 432B may be sixty degrees or less, such as fifty degrees or less, forty degrees or less, thirty degrees or less, twenty-five degrees or less, twenty degrees or less, fifteen degrees or less, ten degrees or less, or five degrees or less. In some embodiments, it is contemplated that any one or more of the acute angles 432A, 432B may be sized such that any one or more of the tapers 419A, 419B may include a self-locking taper, such as a Morse taper. For example, any one or more of the acute angles 432A, 432B may be from 1.0 degrees to 7.5 degrees, such as 1.5 to 7.0 degrees, 2.0 degrees to 6.5 degrees, 2.5 degrees to 5.0 degrees, 3.0 degrees to 4.5 degrees, or 3.5 degrees to 4.0 degrees. In some embodiments, it is contemplated that any one or more of the acute angles 432A, 432B may be sized such that any one or more of the tapers 419A, 419B may include a self-releasing taper, such as an NMTB taper. For example, any one or more of the acute angles 432A, 432B may be 15.5 degrees to 17.5 degrees or greater. In some embodiments, it is contemplated that the taper 419A may include a self-releasing taper, and the taper 419B may include a self-locking taper. In some embodiments, it is contemplated that the taper 419A may include a self-locking taper, and the taper 419B may include a self-releasing taper.

The third portion 430C of the tapered region 430 extends from the first intermediate location 425A to the second intermediate location 425B. In the third portion 430C of the tapered region 430, a portion 418A of the inner wall 418 of the housing 410 extends substantially parallel to the longitudinal axis 406. For example, the portion 418A of the inner wall 418 may extend at angle of less than one degree to the longitudinal axis 406. In some embodiments, it is contemplated that the portion 418A of the inner wall 118 at the third portion 430C of the tapered region 130 may include a groove, notch, or other surface irregularity configured to receive a locking member, such as a locking ring, tab, dog, collet finger, or the like. In other embodiments, it is contemplated that the portion 418A of the inner wall 418 at the third portion 430C of the tapered region 430 may not include a groove, notch, or other surface irregularity. In some embodiments, it is contemplated that the portion 418A of the inner wall 418 at the third portion 430C of the tapered region 430 may include a sealing surface against which a sealing member, such as an o-ring, may be received in order to create a seal.

In a parallel region 440 of the longitudinal bore 416, the inner wall 418 of the housing 410 extends substantially parallel to the longitudinal axis 406, for example, at angle of less than one degree to the longitudinal axis 406. The parallel region 440 extends from the taper end location 426 to a parallel end location 428. Of the taper end 426 and parallel end 428 locations, the parallel end location 428 is closer to the lower end 404. In some embodiments, as illustrated in FIG. 2D, it is contemplated that the parallel end location 428 may be positioned at the lower end 404. In some embodiments, it is contemplated that the parallel end location 428 may be positioned away from the lower end 404. In some embodiments, it is contemplated that the inner wall 418 at the second parallel region 440 may include a sealing surface against which a sealing member, such as an o-ring, may be received in order to create a seal. In some embodiments, it is contemplated that the parallel region 440 may be omitted.

It is contemplated that any of the housings 110, 210, 310, 410 may be made from a material that is similar to, or at least compatible with, the material of a tubular or downhole tool to which any of the housings 110, 210, 310, 410 is to be connected. For example, the material of any of the housings 110, 210, 310, 410 may be a metal, such as steel.

FIG. 3A is a cross-sectional view of an insert 150 of the catcher 100. The insert 150 has an upper end 152, a lower end 154, and a longitudinal axis 156. When the insert 150 is installed in the housing 110 of the catcher 100, the longitudinal axis 156 of the insert 150 is substantially aligned with the longitudinal axis 106 of the housing 110. The insert 150 has a shoulder 164 at the upper end 152. The insert 150 has a longitudinal bore 160 with an inner wall 161 extending from the upper end 152 to the lower end 154. The inner wall 161 includes a seat 162 configured to receive an obturating object, such as a ball, a cone, a dart, a plug, or the like. In some embodiments, it is contemplated that the obturating object may seal against the insert 150 when landed on the seat 162. In some embodiments, it is contemplated that the obturating object may seal against the seat 162 of the insert 150 when landed on the seat 162. In some embodiments, it is contemplated that the obturating object may seal against a portion 161A of the inner wall 161 adjacent the seat 162 of the insert 150 when landed on the seat 162. In some embodiments, it is contemplated that the obturating object may not seal against the insert 150 when landed on the seat 162. In some embodiments, it is contemplated that the obturating object may inhibit fluid flow through the insert 150 when landed on the seat 162.

The insert 150 has an outer wall 166. A parallel region 170 of the outer wall 166 includes a portion 166A of the outer wall 166 of the insert 150 extending substantially parallel to the longitudinal axis 156. For example, the portion 166A of the outer wall 166 may extend at angle of less than one degree to the longitudinal axis 156. The parallel region 170 extends from a parallel start location 172 to a taper start location 174. Of the two locations 172, 174, the parallel start location 172 is closer to the upper end 152. As shown in FIG. 3A, the portion 166A of the outer wall 166 includes a groove 168 configured to house a sealing member, such as an o-ring. However, in some embodiments it is contemplated that the groove 168 may be omitted.

A tapered region 180 of the outer wall 166 is frustoconical, and includes a taper 169 generally extending at an acute angle 182 to the longitudinal axis 156 from the taper start location 174 to a taper end location 176. For the purpose of illustration, FIG. 3A1 shows the taper 169 extending at acute angle 182 to datum line 156', which is parallel to the longitudinal axis 156. Of the taper start 174 and taper end 176 locations, the taper end location 176 is closer to the lower end 154. The taper 169 is such that an outer diameter of the insert 150 at the taper start location 174 is greater than an outer diameter of the insert 150 at the taper end location 176. In some embodiments, it is contemplated that the outer wall 166 at the tapered region 180 includes a groove configured to house a sealing member, such as an o-ring.

In some embodiments, it is contemplated that the acute angle 182 may be sixty degrees or less, such as fifty degrees or less, forty degrees or less, thirty degrees or less, twenty-five degrees or less, twenty degrees or less, fifteen degrees or less, ten degrees or less, or five degrees or less. In some embodiments, it is contemplated that the acute angle 182 may be sized such that the taper 179 may include a self-locking taper, such as a Morse taper. For example, the acute angle 182 may be from 1.0 degrees to 7.5 degrees, such as 1.5 to 7.0 degrees, 2.0 degrees to 6.5 degrees, 2.5 degrees to 5.0 degrees, 3.0 degrees to 4.5 degrees, or 3.5 degrees to 4.0 degrees. In some embodiments, it is contemplated that the acute angle 182 may be sized such that the taper 179 may include a self-releasing taper, such as an NMTB taper. For example, the acute angle 182 may be 15.5 degrees to 17.5 degrees or greater. In some embodiments, it is contemplated that the acute angle 182 may be substantially equal to the acute angle 132 of the taper 119 of the inner wall 118 of the housing 110. For example, the acute angles 132 and 182 may differ by from zero degrees to one degree. In some embodiments, it is contemplated that the acute angle 182 may not be substantially equal to the acute angle 132 of the taper 119 of the inner wall 118 of the housing 110.

FIG. 3B is a cross-sectional view of an insert 250 of the catcher 200. Elements of insert 250 of catcher 200 that are equivalent to corresponding elements of insert 150 of catcher 100 are numbered similarly, but starting with 200 instead of 100. The insert 250 has an upper end 252, a lower end 254, and a longitudinal axis 256. When the insert 250 is installed in the housing 210 of the catcher 200, the longitudinal axis 256 of the insert 250 is substantially aligned with the longitudinal axis 206 of the housing 210. The insert 250 has a shoulder 264 at the upper end 252. The insert 250 has a longitudinal bore 260 with an inner wall 261 extending from the upper end 252 to the lower end 254. The inner wall 261 includes a seat 262 configured to receive an obturating object, such as a ball, a cone, a dart, a plug, or the like. In some embodiments, it is contemplated that the obturating object may seal against the insert 250 when landed on the seat 262. In some embodiments, it is contemplated that the obturating object may seal against the seat 262 of the insert 250 when landed on the seat 262. In some embodiments, it is contemplated that the obturating object may seal against a portion 261A of the inner wall 261 adjacent the seat 262 of the insert 250 when landed on the seat 262. In some embodiments, it is contemplated that the obturating object may not seal against the insert 250 when landed on the seat 262. In some embodiments, it is contemplated that the obturating object may inhibit fluid flow through the insert 250 when landed on the seat 262.

The insert 250 has an outer wall 266. A parallel region 270 of the outer wall 266 includes a portion 266A of the outer wall 266 of the insert 250 extending substantially parallel to the longitudinal axis 256. For example, the portion 266A of the outer wall 266 may extend at angle of less than one degree to the longitudinal axis 256. The parallel region 270 extends from a parallel start location 272 to a taper start location 274. Of the two locations 272, 274, the parallel start location 272 is closer to the upper end 252. As shown in FIG. 3B, the portion 266A of the outer wall 266 includes a groove 268 configured to house a sealing member, such as an o-ring. However, in some embodiments it is contemplated that the groove 268 may be omitted.

A tapered region 280 of the outer wall 266 includes first and second portions 280A, 280B, respectively. In the first portion 280A, the outer wall 266 of the insert 250 is frustoconical, and has a taper 269A extending at an acute angle 282A to the longitudinal axis 256 from the taper start location 274 to an intermediate location 275. For the purpose of illustration, FIG. 3B1 shows the taper 269A extending at acute angle 282A to datum line 256', which is parallel to the longitudinal axis 256. Of the taper start 274 and intermediate 275 locations, the intermediate location 275 is closer to the lower end 254. The taper 269A is such that an outer diameter of the insert 250 at the taper start location 274 is greater than an outer diameter of the insert 250 at the intermediate location 275. In the second portion 280B, the outer wall 266 of the insert 250 is frustoconical, and has a taper 269B extending at an acute angle 282B to the longitudinal axis 256 from the intermediate location 275 to a taper end location 276. For the purpose of illustration, FIG. 3B2 shows the taper 269B extending at acute angle 282B to datum line 256", which is parallel to the longitudinal axis 256. As illustrated in FIGS. 3B1 and 3B2, acute angle 282B is greater than acute angle 282A.

In some embodiments, it is contemplated that any one or more of the acute angles 282A, 282B may be sixty degrees or less, such as fifty degrees or less, forty degrees or less, thirty degrees or less, twenty-five degrees or less, twenty degrees or less, fifteen degrees or less, ten degrees or less, or five degrees or less. In some embodiments, it is contemplated that any one or more of the acute angles 282A, 282B may be sized such that any one or more of the tapers 269A, 269B may include a self-locking taper, such as a Morse taper. For example, any one or more of the acute angles 282A, 282B may be from 1.0 degrees to 7.5 degrees, such as 1.5 to 7.0 degrees, 2.0 degrees to 6.5 degrees, 2.5 degrees to 5.0 degrees, 3.0 degrees to 4.5 degrees, or 3.5 degrees to 4.0 degrees. In some embodiments, it is contemplated that any one or more of the acute angles 282A, 282B may be sized such that any one or more of the tapers 269A, 269B may include a self-releasing taper, such as an NMTB taper. For example, any one or more of the acute angles 282A, 282B may be 15.5 degrees to 17.5 degrees or greater. In some embodiments, it is contemplated that the taper 269A may include a self-locking taper, and the taper 269B may include a self-releasing taper.

In some embodiments, it is contemplated that the acute angle 282A may be substantially equal to the acute angle 232A of the taper 219A of the inner wall 218 of the housing 210. For example, the acute angles 232A and 282A may differ by from zero degrees to one degree. In some embodiments, it is contemplated that the acute angle 282A may not be substantially equal to the acute angle 232A of the taper 219A of the inner wall 218 of the housing 210. In some embodiments, it is contemplated that the acute angle 282B may be substantially equal to the acute angle 232B of the taper 219B of the inner wall 218 of the housing 210. For example, the acute angles 232B and 282B may differ by from zero degrees to one degree. In some embodiments, it is contemplated that the acute angle 282B may not be substantially equal to the acute angle 232B of the taper 219B of the inner wall 218 of the housing 210.

FIG. 3C is a cross-sectional view of an insert 350 of the catcher 300. Elements of insert 350 of catcher 300 that are equivalent to corresponding elements of insert 150 of catcher 100 are numbered similarly, but starting with 300 instead of 100. The insert 350 has an upper end 352, a lower end 354, and a longitudinal axis 356. When the insert 350 is installed in the housing 310 of the catcher 300, the longitudinal axis 356 of the insert 350 is substantially aligned with the longitudinal axis 306 of the housing 310. The insert 350 has a shoulder 364 at the upper end 352. The insert 350 has a longitudinal bore 360 with an inner wall 361 extending from the upper end 352 to the lower end 354. The inner wall 361 includes a seat 362 configured to receive an obturating object, such as a ball, a cone, a dart, a plug, or the like. In some embodiments, it is contemplated that the obturating object may seal against the insert 350 when landed on the seat 362. In some embodiments, it is contemplated that the obturating object may seal against the seat 362 of the insert 350 when landed on the seat 362. In some embodiments, it is contemplated that the obturating object may seal against a portion 361A of the inner wall 361 adjacent the seat 362 of the insert 350 when landed on the seat 362. In some embodiments, it is contemplated that the obturating object may not seal against the insert 350 when landed on the seat 362. In some embodiments, it is contemplated that the obturating object may inhibit fluid flow through the insert 350 when landed on the seat 362.

The insert 350 has an outer wall 366. A parallel region 370 of the outer wall 366 includes a portion 366A of the outer wall 366 of the insert 350 extending substantially parallel to the longitudinal axis 356. For example, the portion 366A of the outer wall 366 may extend at angle of less than one degree to the longitudinal axis 356. The parallel region 370 extends from a parallel start location 372 to a taper start location 374. Of the two locations 372, 374, the parallel start location 372 is closer to the upper end 352. As shown in FIG. 3C, the portion 366A of the outer wall 366 includes a groove 368 configured to house a sealing member, such as an o-ring. However, in some embodiments it is contemplated that the groove 368 may be omitted.

A tapered region 380 of the outer wall 366 includes first and second portions 380A, 380B, respectively. In the first portion 380A, the outer wall 366 of the insert 350 is frustoconical, and has a taper 369A extending at an acute angle 382A to the longitudinal axis 356 from the taper start location 374 to an intermediate location 375. For the purpose of illustration, FIG. 3C1 shows the taper 369A extending at acute angle 382A to datum line 356', which is parallel to the longitudinal axis 356. Of the taper start 374 and intermediate 375 locations, the intermediate location 375 is closer to the lower end 354. The taper 369A is such that an outer diameter of the insert 350 at the taper start location 374 is greater than an outer diameter of the insert 350 at the intermediate location 375. In the second portion 380B, the outer wall 366 of the insert 350 is frustoconical, and has a taper 369B extending at an acute angle 382B to the longitudinal axis 356 from the intermediate location 375 to a taper end location 376. For the purpose of illustration, FIG. 3C2 shows the taper 369B extending at acute angle 382B to datum line 356", which is parallel to the longitudinal axis 356. As illustrated in FIGS. 3C1 and 3C2, acute angle 382B is greater than acute angle 382A.

In some embodiments, it is contemplated that any one or more of the acute angles 382A, 382B may be sixty degrees or less, such as fifty degrees or less, forty degrees or less, thirty degrees or less, twenty-five degrees or less, twenty degrees or less, fifteen degrees or less, ten degrees or less, or five degrees or less. In some embodiments, it is contemplated that any one or more of the acute angles 382A, 382B may be sized such that any one or more of the tapers 369A, 369B may include a self-locking taper, such as a Morse taper. For example, any one or more of the acute angles 382A, 382B may be from 1.0 degrees to 7.5 degrees, such as 1.5 to 7.0 degrees, 2.0 degrees to 6.5 degrees, 2.5 degrees to 5.0 degrees, 3.0 degrees to 4.5 degrees, or 3.5 degrees to 4.0 degrees. In some embodiments, it is contemplated that any one or more of the acute angles 382A, 382B may be sized such that any one or more of the tapers 369A, 369B may include a self-releasing taper, such as an NMTB taper. For example, any one or more of the acute angles 382A, 382B may be 15.5 degrees to 17.5 degrees or greater. In some embodiments, it is contemplated that the taper 369A may include a self-releasing taper, and the taper 369B may include a self-locking taper.

In some embodiments, it is contemplated that the acute angle 382A may be substantially equal to the acute angle 332A of the taper 319A of the inner wall 318 of the housing 310. For example, the acute angles 332A and 382A may differ by from zero degrees to one degree. In some embodiments, it is contemplated that the acute angle 382A may not be substantially equal to the acute angle 332A of the taper 319A of the inner wall 318 of the housing 310. In some embodiments, it is contemplated that the acute angle 382B may be substantially equal to the acute angle 332B of the taper 319B of the inner wall 318 of the housing 310. For example, the acute angles 332B and 382B may differ by from zero degrees to one degree. In some embodiments, it is contemplated that the acute angle 382B may not be substantially equal to the acute angle 332B of the taper 319B of the inner wall 318 of the housing 310.

In any of the embodiments described with respect to FIGS. 3A to 3C2, it is contemplated that the parallel region 170, 270, 370 may be omitted.

FIG. 3D is a cross-sectional view of an insert 450 of the catcher 400. Elements of insert 450 of catcher 400 that are equivalent to corresponding elements of insert 150 of catcher 100 are numbered similarly, but starting with 400 instead of 100. The insert 450 has an upper end 452, a lower end 454, and a longitudinal axis 456. When the insert 450 is installed in the housing 410 of the catcher 400, the longitudinal axis 456 of the insert 450 is substantially aligned with the longitudinal axis 406 of the housing 410. The insert 450 has a shoulder 464 at the upper end 452. The insert 450 has a longitudinal bore 460 with an inner wall 461 extending from the upper end 452 to the lower end 454. The inner wall 461 includes a seat 462 configured to receive an obturating object, such as a ball, a cone, a dart, a plug, or the like. In some embodiments, it is contemplated that the obturating object may seal against the insert 450 when landed on the seat 462. In some embodiments, it is contemplated that the obturating object may seal against the seat 462 of the insert 450 when landed on the seat 462. In some embodiments, it is contemplated that the obturating object may seal against a portion 461A of the inner wall 461 adjacent the seat 462 of the insert 450 when landed on the seat 462. In some embodiments, it is contemplated that the obturating object may not seal against the insert 450 when landed on the seat 462. In some embodiments, it is contemplated that the obturating object may inhibit fluid flow through the insert 450 when landed on the seat 462.

The insert 450 has an outer wall 466. In FIG. 4D, a parallel region of the outer wall 466 equivalent in location to any one of the parallel regions 170, 270, 370 is omitted. However, in some embodiments it is contemplated that the insert 450 may include a parallel region equivalent in location to any one of the first parallel regions 170, 270, 370.

A tapered region 480 of the outer wall 466 includes first, second, and third portions 480A, 480B, 480C, respectively. The third portion 480C is located between the first 480A and second 480B portions.

In the first portion 480A of the tapered region 480, the outer wall 466 of the insert 450 is frustoconical, and has a taper 469A extending at an acute angle 482A to the longitudinal axis 456 from the taper start location 474 to a first intermediate location 475A. For the purpose of illustration, FIG. 3D1 shows the taper 469A extending at acute angle 482A to datum line 456', which is parallel to the longitudinal axis 456. Of the taper start 474 and first intermediate 475A locations, the first intermediate location 475A is closer to the lower end 454. The taper 469A is such that an outer diameter of the insert 450 at the taper start location 474 is greater than an outer diameter of the insert 450 at the first intermediate location 475A.

In the second portion 480B of the tapered region 480, the outer wall 466 of the insert 450 is frustoconical, and has a taper 469B extending at an acute angle 482B to the longitudinal axis 456 from a taper end location 476 to a second intermediate location 475B. For the purpose of illustration, FIG. 3D2 shows the taper 469B extending at acute angle 482B to datum line 456", which is parallel to the longitudinal axis 456. Of the taper end 476 and second intermediate 475B locations, the taper end location 476 is closer to the lower end 454. The taper 469B is such that an outer diameter of the insert 450 at the second intermediate location 475B is greater than an outer diameter of the insert 450 at the taper end location 476.

In some embodiments, it is contemplated that any one or more of the acute angles 482A, 482B may be sixty degrees or less, such as fifty degrees or less, forty degrees or less, thirty degrees or less, twenty-five degrees or less, twenty degrees or less, fifteen degrees or less, ten degrees or less, or five degrees or less. In some embodiments, it is contemplated that any one or more of the acute angles 482A, 482B may be sized such that any one or more of the tapers 469A, 469B may include a self-locking taper, such as a Morse taper. For example, any one or more of the acute angles 432A, 432B may be from 1.0 degrees to 7.5 degrees, such as 1.5 to 7.0 degrees, 2.0 degrees to 6.5 degrees, 2.5 degrees to 5.0 degrees, 3.0 degrees to 4.5 degrees, or 3.5 degrees to 4.0 degrees. In some embodiments, it is contemplated that any one or more of the acute angles 482A, 482B may be sized such that any one or more of the tapers 469A, 469B may include a self-releasing taper, such as an NMTB taper. For example, any one or more of the acute angles 482A, 482B may be 15.5 degrees to 17.5 degrees or greater. In some embodiments, it is contemplated that the taper 469A may include a self-releasing taper, and the taper 469B may include a self-locking taper. In some embodiments, it is contemplated that the taper 469A may include a self-locking taper, and the taper 469B may include a self-releasing taper.

In some embodiments, it is contemplated that the acute angle 482A may be substantially equal to the acute angle 432A of the taper 419A of the inner wall 418 of the housing 410. For example, the acute angles 432A and 482A may differ by from zero degrees to one degree. In some embodiments, it is contemplated that the acute angle 482A may not be substantially equal to the acute angle 432A of the taper 419A of the inner wall 418 of the housing 410. In some embodiments, it is contemplated that the acute angle 482B may be substantially equal to the acute angle 432B of the taper 4196 of the inner wall 418 of the housing 410. For example, the acute angles 432B and 482B may differ by from zero degrees to one degree. In some embodiments, it is contemplated that the acute angle 482B may not be substantially equal to the acute angle 432B of the taper 4196 of the inner wall 418 of the housing 410.

The third portion 480C of the tapered region 480 extends from the first intermediate location 475A to the second intermediate location 475B. In the third portion 480C of the tapered region 480, a portion 466A of the outer wall 466 of the insert 450 extends substantially parallel to the longitudinal axis 456. For example, the portion 466A of the outer wall 466 may extend at angle of less than one degree to the longitudinal axis 456. As shown in FIG. 3D, the portion 466A of the outer wall 466 includes a groove 468 configured to house a sealing member, such as an o-ring. However, in some embodiments it is contemplated that the groove 468 may be omitted.

It is contemplated that any of the illustrated inserts 150, 250, 350, 450 may be made from a material that is robust when subjected to applied pressure and/or compressive loading, yet readily disintegrates during a drilling operation. For example, the inserts 150, 250, 350, 450 may be made from a non-metallic material, such as a plastic, a composite, a ceramic, a glass, or an organic material such as wood. It is contemplated that a catcher 30, 40, 100, 200, 300, 400 incorporating an insert 150, 250, 350, 450 made from a non-metallic material, such as a plastic, a composite, a ceramic, a glass, or an organic material such as wood, may provide for the catcher 30, 40, 100, 200, 300, 400 to be less expensive than an equivalent catcher having an insert made from a metal. Nevertheless, additionally or alternatively, in some embodiments, it is contemplated that the inserts 150, 250, 350, 450 may be made from a metal, such as aluminum, having a hardness less than that of steel. Additionally, or alternatively, in some embodiments, it is contemplated that the inserts 150, 250, 350, 450 may be made from a material that is soluble in a selected downhole environment. For example, the inserts 150, 250, 350, 450 may be made from polylactic acid or polyglycolic acid.

In embodiments in which an insert 150, 250, 350, 450 is made from a composite, it is contemplated that manufacture of an insert 150, 250, 350, 450 may include wrapping one or more sheet of a first material around a mandrel, applying a resin, and then compressing the composite until the resin has cured. The one or more sheet of the first material may include woven filaments of a fiber, such as glass fiber. After the resin has cured, the composite is removed from the mandrel, and may be machined to the desired shape and size of the insert 150, 250, 350, 450. Alternatively, it is contemplated that the composite may be manufactured by a filament winding technique, as is known in the art, instead of using the one or more sheet of the first material.

In a further alternative, it is contemplated that manufacture of an insert 150, 250, 350, 450 may include building up layers of sheets of the first material on a substantially flat surface, applying a resin, and then compressing the composite until the resin has cured. The one or more sheet of the first material may include woven filaments of a fiber, such as glass fiber. After the resin has cured, the composite is machined to the desired shape and size of the insert 150, 250, 350, 450.

Additionally, or alternatively, it is contemplated that at least a portion of the insert 150, 250, 350, 450 may be formed in a mold. Additionally, or alternatively, it is contemplated that manufacture may include machining the insert 150, 250, 350, 450 to the desired shape and size.

Figure 4A:
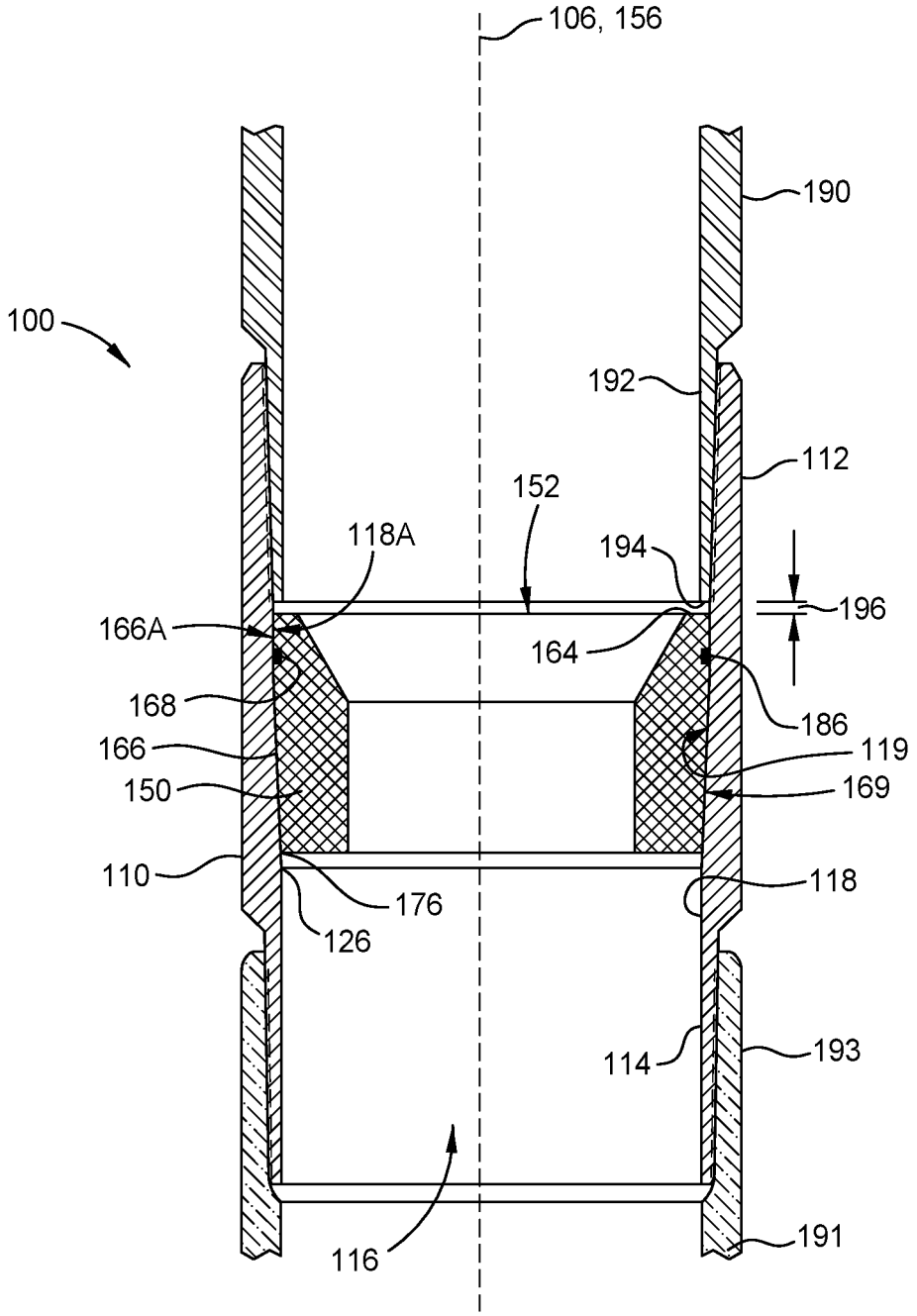
FIG. 4A is a cross-sectional view of a catcher incorporating the housing of FIG. 2A and the insert of FIG. 3A.

FIG. 4A is a cross-sectional view of the catcher 100 incorporating the housing 110 of FIG. 2A and the insert 150 of FIG. 3A. The insert 150 is located in the longitudinal bore 116 of the housing 110 such that the longitudinal axis 156 of the insert 150 at least substantially coincides with the longitudinal axis 106 of the housing 110. The taper 169 of the outer wall 166 of the insert 150 is engaged with the taper 119 of the inner wall 118 of the housing 110. Additionally, the portion 166A of the outer wall 166 of the insert 150 that is substantially parallel to the longitudinal axis 156 is juxtaposed with the portion 118A of the inner wall 118 of the housing 110 that is substantially parallel to the longitudinal axis 106. In some embodiments, it is contemplated that the portion 166A of the outer wall 166 of the insert 150 may be an interference fit with the portion 118A of the inner wall 118 of the housing 110. In some embodiments, it is contemplated that the portion 166A of the outer wall 166 of the insert 150 may not be an interference fit with the portion 118A of the inner wall 118 of the housing 110. A sealing member, such as o-ring 186, in groove 168 of the insert 150 bears against the inner wall 118 of the housing 110 to provide a pressure seal of an interface between the housing 110 and the insert 150.

In some embodiments, it is contemplated that the taper 169 of the outer wall 166 of the insert 150 is an interference fit with the taper 119 of the inner wall 118 of the housing 110. In some embodiments, it is contemplated that the taper 169 of the outer wall 166 of the insert 150 is not an interference fit with the taper 119 of the inner wall 118 of the housing 110. In some embodiments, it is contemplated that the taper 169 of the outer wall 166 of the insert 150 engaged with the taper 119 of the inner wall 118 of the housing 110 forms a self-locking taper connection. In some embodiments, it is contemplated that the taper 169 of the outer wall 166 of the insert 150 engaged with the taper 119 of the inner wall 118 of the housing 110 forms a self-releasing taper connection.

As shown in FIG. 4A, the taper end location 176 of the outer wall 166 of the insert 150 is not positioned adjacent to the taper end location 126 of the inner wall 118 of the housing 110. However, in some embodiments, it is contemplated that the taper end location 176 of the outer wall 166 of the insert 150 may be positioned adjacent to the taper end location 126 of the inner wall 118 of the housing 110.

FIG. 4A shows the catcher 100 coupled to an adjoining item 190 via the top connector 112 being engaged with a connector 192 of the adjoining item 190. FIG. 4A shows also the catcher 100 coupled to an adjoining item 191 via the bottom connector 114 being engaged with a connector 193 of the adjoining item 191. It is contemplated that each adjoining item 190, 191 may be a tubular, such as a joint of casing; a tool, such as packer 18 or stage tool 16; or some other item of oilfield equipment. An end 194 of the connector 192 is separated from the shoulder 164 at the upper end 152 of the insert 150 by a gap 196. In some embodiments, it is contemplated that the end 194 of the connector 192 may not be separated from the shoulder 164 at the upper end 152 of the insert 150 by a gap, and hence the gap 196 may be absent. In some embodiments, it is contemplated that the end 194 of the connector 192 may apply a load against the shoulder 164 of the insert 150, thereby promoting an interference fit between the taper 169 of the outer wall 166 of the insert 150 and the taper 119 of the inner wall 118 of the housing 110.

Figure 4B:
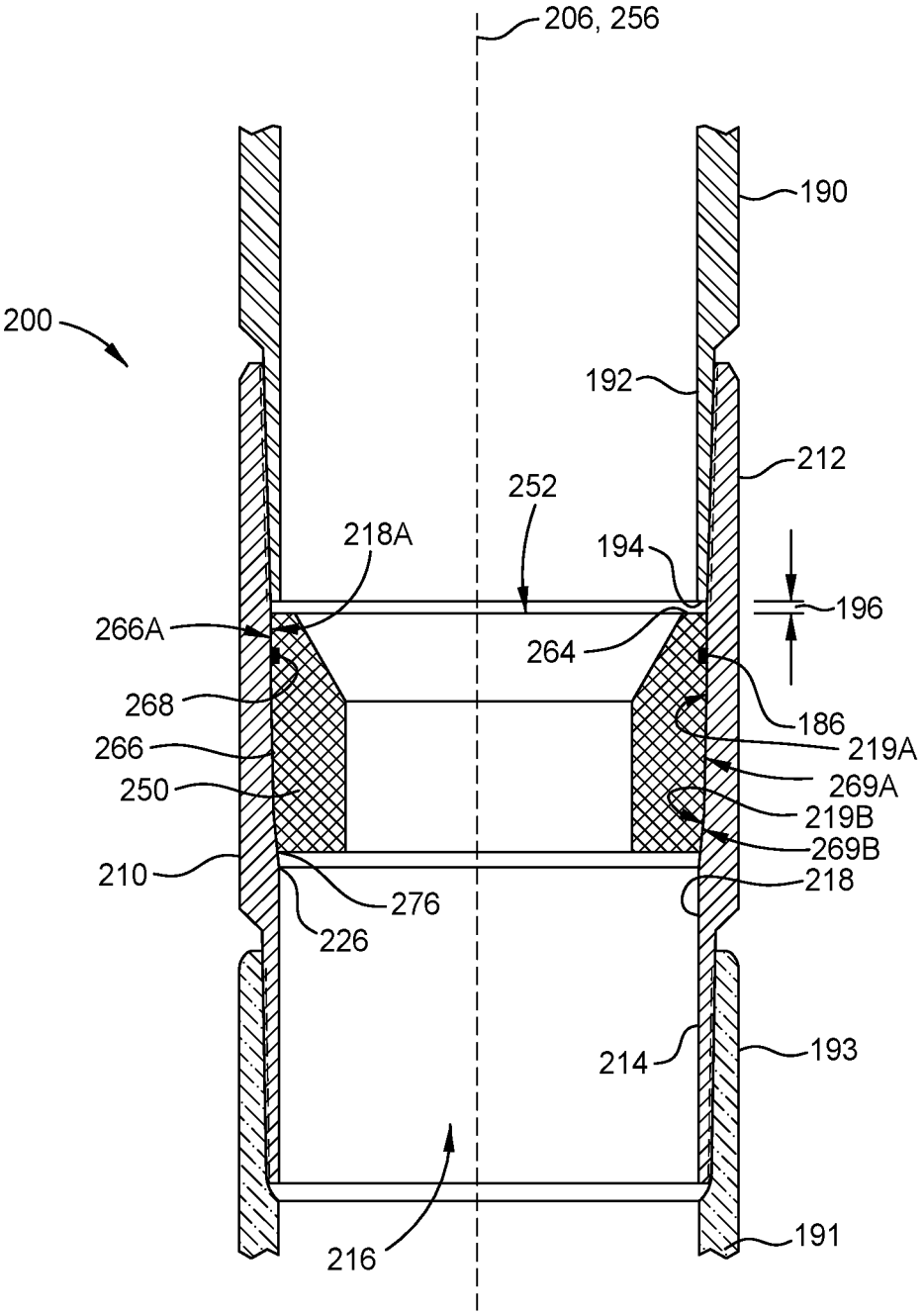
FIG. 4B is a cross-sectional view of a catcher incorporating the housing of FIG. 2B and the insert of FIG. 3B.

FIG. 4B is a cross-sectional view of the catcher 200 incorporating the housing 210 of FIG. 2B and the insert 250 of FIG. 3B. The insert 250 is located in the longitudinal bore 216 of the housing 210 such that the longitudinal axis 256 of the insert 250 at least substantially coincides with the longitudinal axis 206 of the housing 210. The taper 269A of the outer wall 266 of the insert 250 is engaged with the taper 219A of the inner wall 218 of the housing 210. The taper 269B of the outer wall 266 of the insert 250 is engaged with the taper 2196 of the inner wall 218 of the housing 210. Additionally, the portion 266A of the outer wall 266 of the insert 250 that is substantially parallel to the longitudinal axis 256 is juxtaposed with the portion 218A of the inner wall 218 of the housing 210 that is substantially parallel to the longitudinal axis 206. In some embodiments, it is contemplated that the portion 266A of the outer wall 266 of the insert 250 may be an interference fit with the portion 218A of the inner wall 218 of the housing 210. In some embodiments, it is contemplated that the portion 266A of the outer wall 266 of the insert 250 may not be an interference fit with the portion 218A of the inner wall 218 of the housing 210. A sealing member, such as o-ring 186, in groove 268 of the insert 250 bears against the inner wall 218 of the housing 210 to provide a pressure seal of an interface between the housing 210 and the insert 250.

In some embodiments, it is contemplated that the taper 269A of the outer wall 266 of the insert 250 is an interference fit with the taper 219A of the inner wall 218 of the housing 210. In some embodiments, it is contemplated that the taper 269A of the outer wall 266 of the insert 250 is not an interference fit with the taper 219A of the inner wall 218 of the housing 210. In some embodiments, it is contemplated that the taper 269A of the outer wall 266 of the insert 250 engaged with the taper 219A of the inner wall 218 of the housing 210 forms a self-locking taper connection. In some embodiments, it is contemplated that the taper 269A of the outer wall 266 of the insert 250 engaged with the taper 219A of the inner wall 218 of the housing 210 forms a self-releasing taper connection.

In some embodiments, it is contemplated that the taper 269B of the outer wall 266 of the insert 250 is an interference fit with the taper 2196 of the inner wall 218 of the housing 210. In some embodiments, it is contemplated that the taper 269B of the outer wall 266 of the insert 250 is not an interference fit with the taper 219B of the inner wall 218 of the housing 210. In some embodiments, it is contemplated that the taper 269B of the outer wall 266 of the insert 250 engaged with the taper 219B of the inner wall 218 of the housing 210 forms a self-locking taper connection. In some embodiments, it is contemplated that the taper 269B of the outer wall 266 of the insert 250 engaged with the taper 219B of the inner wall 218 of the housing 210 forms a self-releasing taper connection.

As shown in FIG. 4B, the taper end location 276 of the outer wall 266 of the insert 250 is not positioned adjacent to the taper end location 226 of the inner wall 218 of the housing 210. However, in some embodiments, it is contemplated that the taper end location 276 of the outer wall 266 of the insert 250 may be positioned adjacent to the taper end location 226 of the inner wall 218 of the housing 210.

FIG. 4B shows the catcher 200 coupled to an adjoining item 190 via the top connector 212 being engaged with a connector 192 of the adjoining item 190. FIG. 4B shows also the catcher 200 coupled to an adjoining item 191 via the bottom connector 214 being engaged with a connector 193 of the adjoining item 191. It is contemplated that each adjoining item 190, 191 may be a tubular, such as a joint of casing; a tool, such as packer 18 or stage tool 16; or some other item of oilfield equipment. An end 194 of the connector 192 is separated from the shoulder 264 at the upper end 252 of the insert 250 by a gap 196. In some embodiments, it is contemplated that the end 194 of the connector 192 may not be separated from the shoulder 264 at the upper end 252 of the insert 250 by a gap, and hence the gap 196 may be absent. In some embodiments, it is contemplated that the end 194 of the connector 192 may apply a load against the shoulder 264 of the insert 250, thereby promoting an interference fit between the taper 269A of the outer wall 266 of the insert 250 and the taper 219A of the inner wall 218 of the housing 210. In some embodiments, it is contemplated that the end 194 of the connector 192 may apply a load against the shoulder 264 of the insert 250, thereby promoting an interference fit between the taper 269B of the outer wall 266 of the insert 250 and the taper 219B of the inner wall 218 of the housing 210.

Figure 4C:
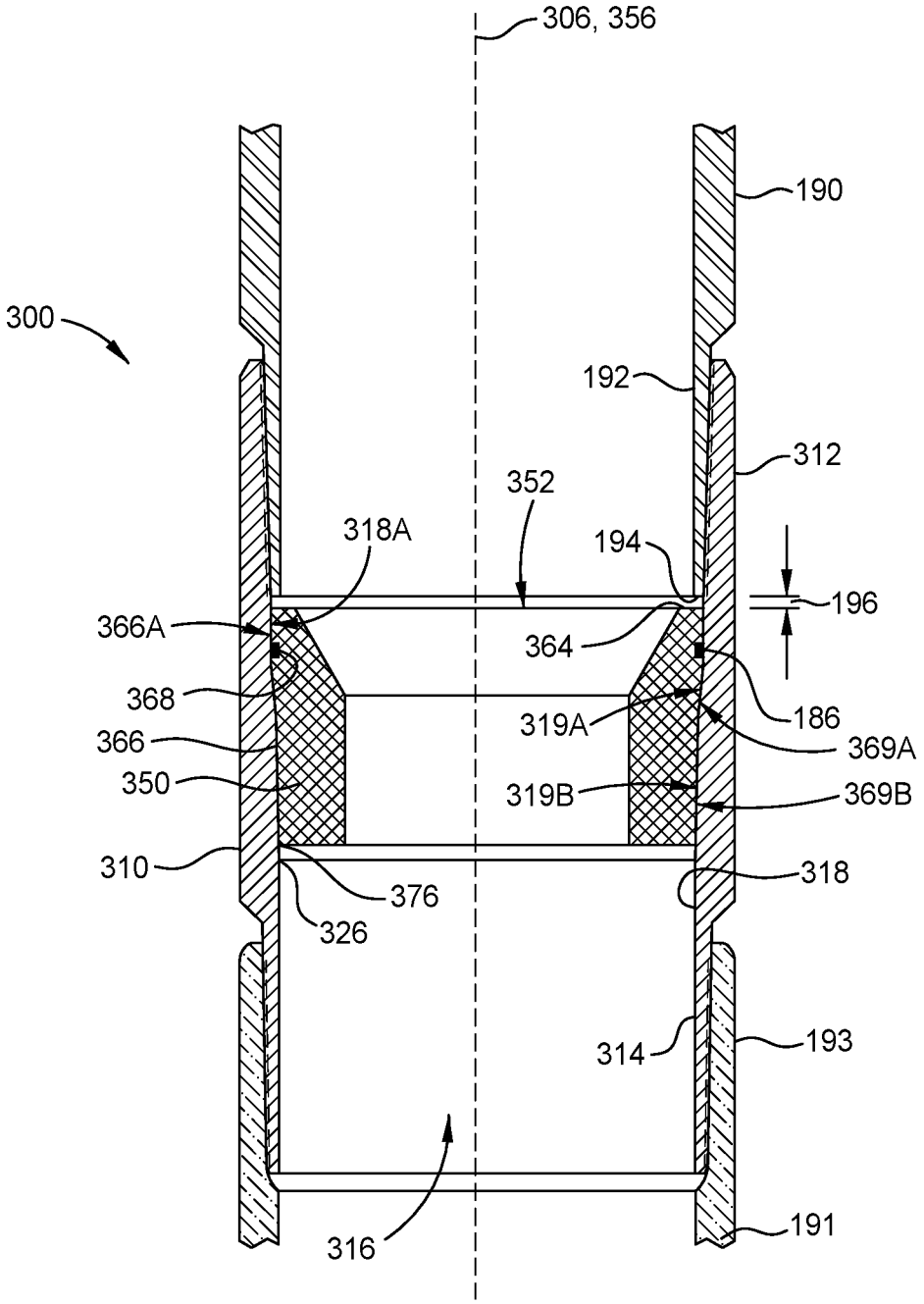
FIG. 4C is a cross-sectional view of a catcher incorporating the housing of FIG. 2C and the insert of FIG. 3C.
Figure 4D:
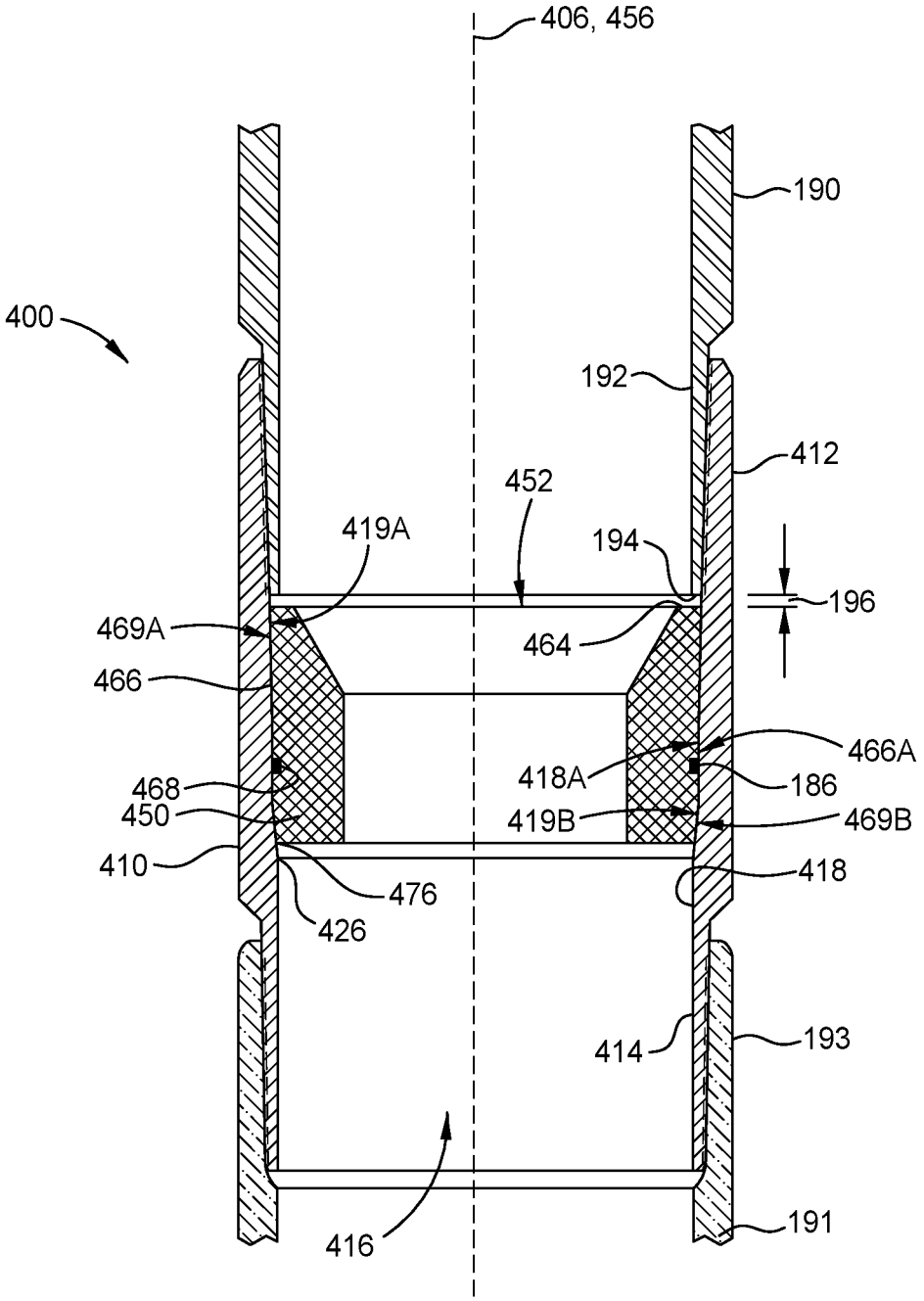
FIG. 4D is a cross-sectional view of a catcher incorporating the housing of FIG. 2D and the insert of FIG. 3D.

FIG. 4C is a cross-sectional view of the catcher 300 incorporating the housing 310 of FIG. 2C and the insert 350 of FIG. 3C. The insert 350 is located in the longitudinal bore 316 of the housing 310 such that the longitudinal axis 356 of the insert 350 at least substantially coincides with the longitudinal axis 306 of the housing 310. The taper 369A of the outer wall 366 of the insert 350 is engaged with the taper 319A of the inner wall 318 of the housing 310. The taper 369B of the outer wall 366 of the insert 350 is engaged with the taper 3196 of the inner wall 318 of the housing 310. Additionally, the portion 366A of the outer wall 366 of the insert 350 that is substantially parallel to the longitudinal axis 356 is juxtaposed with the portion 318A of the inner wall 318 of the housing 310 that is substantially parallel to the longitudinal axis 306. In some embodiments, it is contemplated that the portion 366A of the outer wall 366 of the insert 350 may be an interference fit with the portion 318A of the inner wall 318 of the housing 310. In some embodiments, it is contemplated that the portion 366A of the outer wall 366 of the insert 350 may not be an interference fit with the portion 318A of the inner wall 318 of the housing 310. A sealing member, such as o-ring 186, in groove 368 of the insert 350 bears against the inner wall 318 of the housing 310 to provide a pressure seal of an interface between the housing 310 and the insert 350.

In some embodiments, it is contemplated that the taper 369A of the outer wall 366 of the insert 350 is an interference fit with the taper 319A of the inner wall 318 of the housing 310. In some embodiments, it is contemplated that the taper 369A of the outer wall 366 of the insert 350 is not an interference fit with the taper 319A of the inner wall 318 of the housing 310. In some embodiments, it is contemplated that the taper 369A of the outer wall 366 of the insert 350 engaged with the taper 319A of the inner wall 318 of the housing 310 forms a self-locking taper connection. In some embodiments, it is contemplated that the taper 369A of the outer wall 366 of the insert 350 engaged with the taper 319A of the inner wall 318 of the housing 310 forms a self-releasing taper connection.

In some embodiments, it is contemplated that the taper 369B of the outer wall 366 of the insert 350 is an interference fit with the taper 3196 of the inner wall 318 of the housing 310. In some embodiments, it is contemplated that the taper 369B of the outer wall 366 of the insert 350 is not an interference fit with the taper 319B of the inner wall 318 of the housing 310. In some embodiments, it is contemplated that the taper 369B of the outer wall 366 of the insert 350 engaged with the taper 3196 of the inner wall 318 of the housing 310 forms a self-locking taper connection. In some embodiments, it is contemplated that the taper 369B of the outer wall 366 of the insert 350 engaged with the taper 3196 of the inner wall 318 of the housing 310 forms a self-releasing taper connection.

As shown in FIG. 4C, the taper end location 376 of the outer wall 366 of the insert 350 is not positioned adjacent to the taper end location 326 of the inner wall 318 of the housing 310. However, in some embodiments, it is contemplated that the taper end location 376 of the outer wall 366 of the insert 350 may be positioned adjacent to the taper end location 326 of the inner wall 318 of the housing 310.

FIG. 4C shows the catcher 300 coupled to an adjoining item 190 via the top connector 312 being engaged with a connector 192 of the adjoining item 190. FIG. 4C shows also the catcher 300 coupled to an adjoining item 191 via the bottom connector 314 being engaged with a connector 193 of the adjoining item 191. It is contemplated that each adjoining item 190, 191 may be a tubular, such as a joint of casing; a tool, such as packer 18 or stage tool 16; or some other item of oilfield equipment. An end 194 of the connector 192 is separated from the shoulder 364 at the upper end 352 of the insert 350 by a gap 196. In some embodiments, it is contemplated that the end 194 of the connector 192 may not be separated from the shoulder 364 at the upper end 352 of the insert 350 by a gap, and hence the gap 196 may be absent. In some embodiments, it is contemplated that the end 194 of the connector 192 may apply a load against the shoulder 364 of the insert 350, thereby promoting an interference fit between the taper 369A of the outer wall 366 of the insert 350 and the taper 319A of the inner wall 318 of the housing 310. In some embodiments, it is contemplated that the end 194 of the connector 192 may apply a load against the shoulder 364 of the insert 350, thereby promoting an interference fit between the taper 369B of the outer wall 366 of the insert 350 and the taper 3196 of the inner wall 318 of the housing 310.

FIG. 4D is a cross-sectional view of the catcher 400 incorporating the housing 410 of FIG. 2D and the insert 450 of FIG. 3D. The insert 450 is located in the longitudinal bore 416 of the housing 410 such that the longitudinal axis 456 of the insert 450 at least substantially coincides with the longitudinal axis 406 of the housing 410. The taper 469A of the outer wall 466 of the insert 450 is engaged with the taper 419A of the inner wall 418 of the housing 410. The taper 469B of the outer wall 466 of the insert 450 is engaged with the taper 4196 of the inner wall 418 of the housing 410. Additionally, the portion 466A of the outer wall 466 of the insert 450 that is substantially parallel to the longitudinal axis 456 is juxtaposed with the portion 418A of the inner wall 418 of the housing 410 that is substantially parallel to the longitudinal axis 406. In some embodiments, it is contemplated that the portion 466A of the outer wall 466 of the insert 450 may be an interference fit with the portion 418A of the inner wall 418 of the housing 410. In some embodiments, it is contemplated that the portion 466A of the outer wall 466 of the insert 450 may not be an interference fit with the portion 418A of the inner wall 418 of the housing 410. A sealing member, such as o-ring 186, in groove 468 of the insert 450 bears against the inner wall 418 of the housing 410 to provide a pressure seal of an interface between the housing 410 and the insert 450.

In some embodiments, it is contemplated that the taper 469A of the outer wall 466 of the insert 450 is an interference fit with the taper 419A of the inner wall 418 of the housing 410. In some embodiments, it is contemplated that the taper 469A of the outer wall 466 of the insert 450 is not an interference fit with the taper 419A of the inner wall 418 of the housing 410. In some embodiments, it is contemplated that the taper 469A of the outer wall 466 of the insert 450 engaged with the taper 419A of the inner wall 418 of the housing 410 forms a self-locking taper connection. In some embodiments, it is contemplated that the taper 469A of the outer wall 466 of the insert 450 engaged with the taper 419A of the inner wall 418 of the housing 410 forms a self-releasing taper connection.

In some embodiments, it is contemplated that the taper 469B of the outer wall 466 of the insert 450 is an interference fit with the taper 4196 of the inner wall 418 of the housing 410. In some embodiments, it is contemplated that the taper 469B of the outer wall 466 of the insert 450 is not an interference fit with the taper 419B of the inner wall 418 of the housing 410. In some embodiments, it is contemplated that the taper 469B of the outer wall 466 of the insert 450 engaged with the taper 4196 of the inner wall 418 of the housing 410 forms a self-locking taper connection. In some embodiments, it is contemplated that the taper 469B of the outer wall 466 of the insert 450 engaged with the taper 4196 of the inner wall 418 of the housing 410 forms a self-releasing taper connection.

As shown in FIG. 4D, the taper end location 476 of the outer wall 466 of the insert 450 is not positioned adjacent to the taper end location 426 of the inner wall 418 of the housing 410. However, in some embodiments, it is contemplated that the taper end location 476 of the outer wall 466 of the insert 450 may be positioned adjacent to the taper end location 426 of the inner wall 418 of the housing 410.

FIG. 4D shows the catcher 400 coupled to an adjoining item 190 via the top connector 412 being engaged with a connector 192 of the adjoining item 190. FIG. 4D shows also the catcher 400 coupled to an adjoining item 191 via the bottom connector 414 being engaged with a connector 193 of the adjoining item 191. It is contemplated that each adjoining item 190, 191 may be a tubular, such as a joint of casing; a tool, such as packer 18 or stage tool 16; or some other item of oilfield equipment. An end 194 of the connector 192 is separated from the shoulder 464 at the upper end 452 of the insert 450 by a gap 196. In some embodiments, it is contemplated that the end 194 of the connector 192 may not be separated from the shoulder 464 at the upper end 452 of the insert 450 by a gap, and hence the gap 196 may be absent. In some embodiments, it is contemplated that the end 194 of the connector 192 may apply a load against the shoulder 464 of the insert 450, thereby promoting an interference fit between the taper 469A of the outer wall 466 of the insert 450 and the taper 419A of the inner wall 418 of the housing 410. In some embodiments, it is contemplated that the end 194 of the connector 192 may apply a load against the shoulder 464 of the insert 450, thereby promoting an interference fit between the taper 469B of the outer wall 466 of the insert 450 and the taper 4196 of the inner wall 418 of the housing 410.

Figure 5:
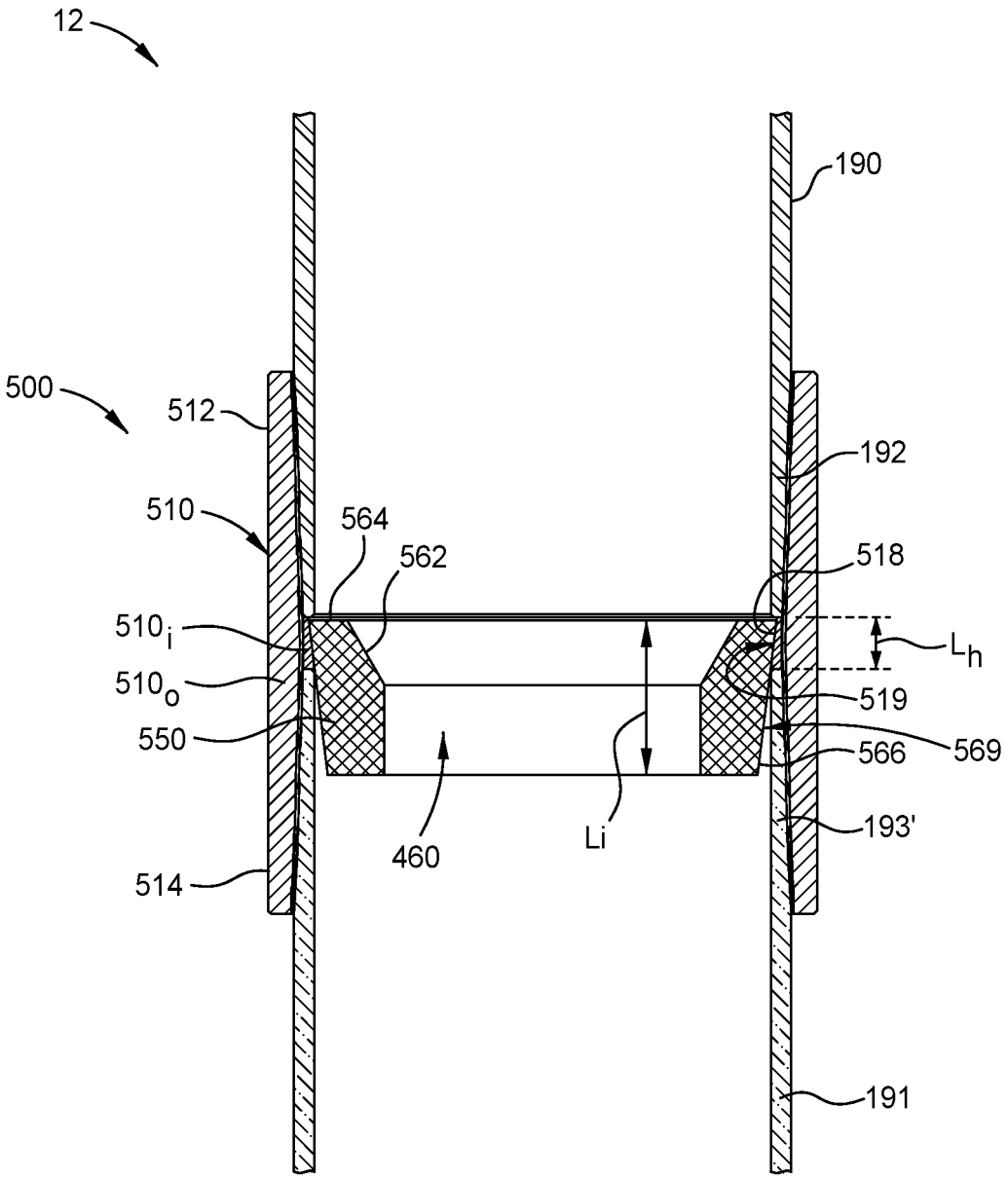
FIG. 5 is a cross-sectional view of an alternative embodiment of a catcher.

FIG. 5 is a cross-sectional view of an alternative embodiment of a catcher. Elements of catcher 500 that are equivalent to corresponding elements of catchers 100, 200, 300, and 400 are numbered similarly, but starting with 500 instead of 100, 200, 300, 400, respectively. The catcher 500 is illustrated when forming part of a casing string 12, being coupled to an adjoining item 190 via a top connector 512 engaged with a connector 192 of the adjoining item 190. The catcher 500 is illustrated to be coupled to an adjoining item 191 via a bottom connector 514 engaged with a connector 193' of the adjoining item 191. As shown, the bottom connector 514 is a threaded box configured to mate with a corresponding threaded pin 193'. However, in some embodiments it is contemplated that the bottom connector 514 may be a threaded pin configured to mate with a corresponding threaded box, such as connector 193 shown in FIGS. 4A-4D. It is contemplated that each adjoining item 190, 191 may be a tubular, such as a joint of casing; a tool, such as packer 18 or stage tool 16; or some other item of oilfield equipment.

The catcher 500 includes a housing 510 and an insert 550 disposed in the housing 510. The housing 510 includes an outer housing 510*o* surrounding an inner housing 510*i*. It is contemplated that the outer housing 510*o* may be a casing coupling, such as a standard casing coupling as used with buttress-threaded casing. It is contemplated that the inner housing 510*i* may be a torque ring, such as may be used with buttress-threaded casing. As shown in FIG. 5, the inner housing 510*i* is located within the outer housing 510*o* and between the connectors 192 and 193'. In some embodiments, such as when the inner housing 510*i* is a torque ring, it is contemplated that connectors 192 and 193' bear against the inner housing 510*i*.

At least a portion of an outer wall 566 of the insert 550 is frustoconical, and includes a taper 569 that is engaged with a corresponding frustoconical taper 519 of the inner wall 518 of the inner housing 510*i*. It is contemplated that taper 569 may be configured similarly to any of the tapers or combinations of tapers 169, 269A, 269B, 369A, 369B, 469A and 469B. It is contemplated that taper 519 may be configured similarly to any of the tapers or combinations of tapers 119, 219A, 219B, 319A, 319B, 419A and 419B. In some embodiments, it is contemplated that the taper 569 of the outer wall 566 of the insert 550 engaged with the taper 519 of the inner wall 518 of the housing 510*i* forms a self-locking taper connection. In some embodiments, it is contemplated that the taper 569 of the outer wall 566 of the insert 550 engaged with the taper 519 of the inner wall 518 of the housing 510*i* forms a self-releasing taper connection.

As illustrated in FIG. 5, a length Lh of the inner housing 510*i* is less than a length Li of the insert 550. It is contemplated that the length Lh of the inner housing 510*i* may be less than or equal to 50% of the length Li of the insert 550, such as less than or equal to 40% of the length Li of the insert 550, such as less than or equal to 35% of the length Li of the insert 550, such as less than or equal to 30% of the length Li of the insert 550.

Similar to inserts 150, 250, 350, and 450, the insert 550 has a shoulder 564, a longitudinal bore 560, and a seat 562. The seat 562 is configured to receive an obturating object, such as a ball, a cone, a dart, a plug, or the like. In some embodiments, it is contemplated that the obturating object may seal against the insert 550 when landed on the seat 562.

It is contemplated that the housing 510, including outer housing 510*o* and inner housing 510*i*, may be made from a material similar to any of the housings 110, 210, 310, and 410. It is contemplated that the insert 550 may be made from a material similar to any of the inserts 150, 250, 350, and 450.

Figure 6:
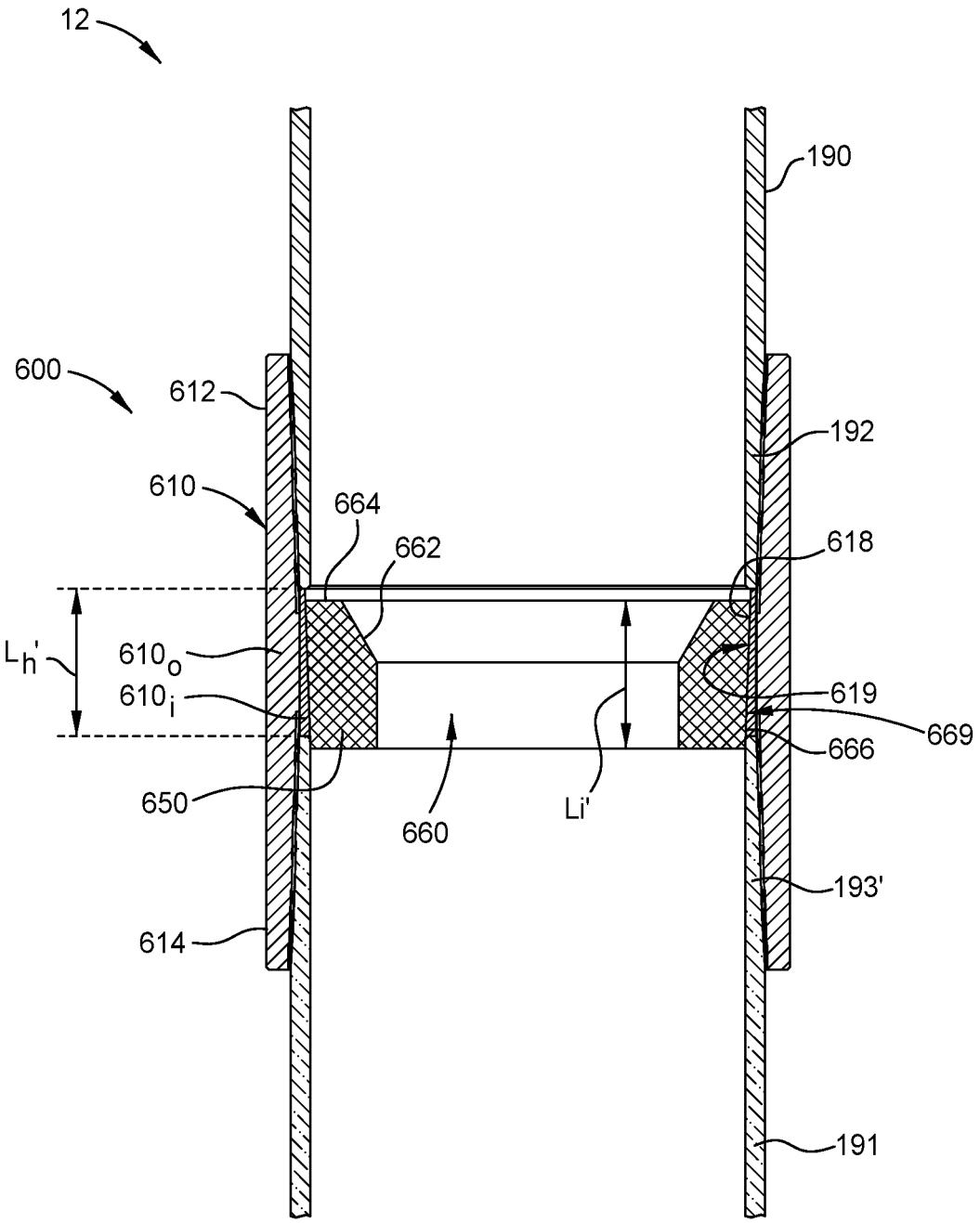
FIG. 6 is a cross-sectional view of an alternative embodiment of the catcher of FIG. 5.

FIG. 6 is a cross-sectional view of an alternative embodiment of the catcher of FIG. 5. Elements of catcher 600 that are equivalent to corresponding elements of catchers 100, 200, 300, 400, and 500 are numbered similarly, but starting with 600 instead of 100, 200, 300, 400, 500, respectively. The catcher 600 is illustrated when forming part of a casing string 12, being coupled to an adjoining item 190 via a top connector 612 engaged with a connector 192 of the adjoining item 190. The catcher 600 is illustrated to be coupled to an adjoining item 191 via a bottom connector 614 engaged with a connector 193' of the adjoining item 191. As shown, the bottom connector 614 is a threaded box configured to mate with a corresponding threaded pin 193'. However, in some embodiments it is contemplated that the bottom connector 614 may be a threaded pin configured to mate with a corresponding threaded box, such as connector 193 shown in FIGS. 4A-4D. It is contemplated that each adjoining item 190, 191 may be a tubular, such as a joint of casing; a tool, such as packer 18 or stage tool 16; or some other item of oilfield equipment.

The catcher 600 includes a housing 610 and an insert 650 disposed in the housing 610. The housing 610 includes an outer housing 610*o* surrounding an inner housing 610*i*. It is contemplated that the outer housing 610*o* may be an elongated casing coupling, such as a casing coupling as used with buttress-threaded casing for certain drilling with casing operations. It is contemplated that the inner housing 610*i* may be a torque ring, such as may be used with buttress-threaded casing. As shown in FIG. 6, the inner housing 610*i* is located within the outer housing 610*o* and between the connectors 192 and 193'. In some embodiments, such as when the inner housing 610*i* is a torque ring, it is contemplated that connectors 192 and 193' bear against the inner housing 610*i*.

At least a portion of an outer wall 666 of the insert 650 is frustoconical, and includes a taper 669 that is engaged with a corresponding frustoconical taper 619 of the inner wall 618 of the inner housing 610*i*. It is contemplated that taper 669 may be configured similarly to any of the tapers or combinations of tapers 169, 269A, 269B, 369A, 369B, 469A, 469B, and 569. It is contemplated that taper 619 may be configured similarly to any of the tapers or combinations of tapers 119, 219A, 219B, 319A, 319B, 419A, 419B, and 519. In some embodiments, it is contemplated that the taper 669 of the outer wall 666 of the insert 650 engaged with the taper 619 of the inner wall 618 of the housing 610*i* forms a self-locking taper connection. In some embodiments, it is contemplated that the taper 669 of the outer wall 666 of the insert 650 engaged with the taper 619 of the inner wall 618 of the housing 610*i* forms a self-releasing taper connection.

As illustrated in FIG. 6, a length Lh' of the inner housing 610*i* is approximately equal to a length Li' of the insert 650. For example, lengths Lh' and Li' may differ by up to 5%. In some embodiments, it is contemplated that the length Lh' of the inner housing 610*i* may be from 50% to 95% of the length Li' of the insert 650, such as from 60% to 80%, such as from 65% to 75% of the length Li' of the insert 650. In some embodiments, it is contemplated that the length Li' of the insert 650 may be from 50% to 95% of the length Lh' of the inner housing 610*i*, such as from 60% to 80%, such as from 65% to 75% of the length Lh' of the inner housing 610*i*.

Similar to inserts 150, 250, 350, 450, and 550, the insert 650 has a shoulder 664, a longitudinal bore 660, and a seat 662. The seat 662 is configured to receive an obturating object, such as a ball, a cone, a dart, a plug, or the like. In some embodiments, it is contemplated that the obturating object may seal against the insert 650 when landed on the seat 662.

It is contemplated that the housing 610, including outer housing 610*o* and inner housing 610*i*, may be made from a material similar to any of the housings 110, 210, 310, 410, and 510. It is contemplated that the insert 650 may be made from a material similar to any of the inserts 150, 250, 350, 450, and 550.

It is contemplated that any of the inserts 150, 250, 350, 450, 550, 650 may include a longitudinal bore 160, 260, 360, 460, 560, 660, respectively, having a profile of any desired form, shape, or size. For example, any of the inserts 150, 250, 350, 450, 550, 650 may include a longitudinal bore 160, 260, 360, 460, 560, 660, respectively, having multiple seats 162, 262, 362, 462, 562, 662, respectively, or no seats. Additionally, or alternatively, a minimum inner diameter of any one of the inserts 150, 250, 350, 450, 550, 650 may be greater than or less than a minimum inner diameter of any other one of the inserts 150, 250, 350, 450, 550, 650, respectively. Furthermore, it is contemplated that inserts 150, 250, 350, 450, 550, 650 having different profiles of throughbore 160, 260, 360, 460, 560, 660, respectively, may be interchangeable such that that any one housing 110, 210, 310, 410, 510, 610 may receive any one of a selection of differing inserts 150, 250, 350, 450, 550, 650, respectively.

Figure 7:
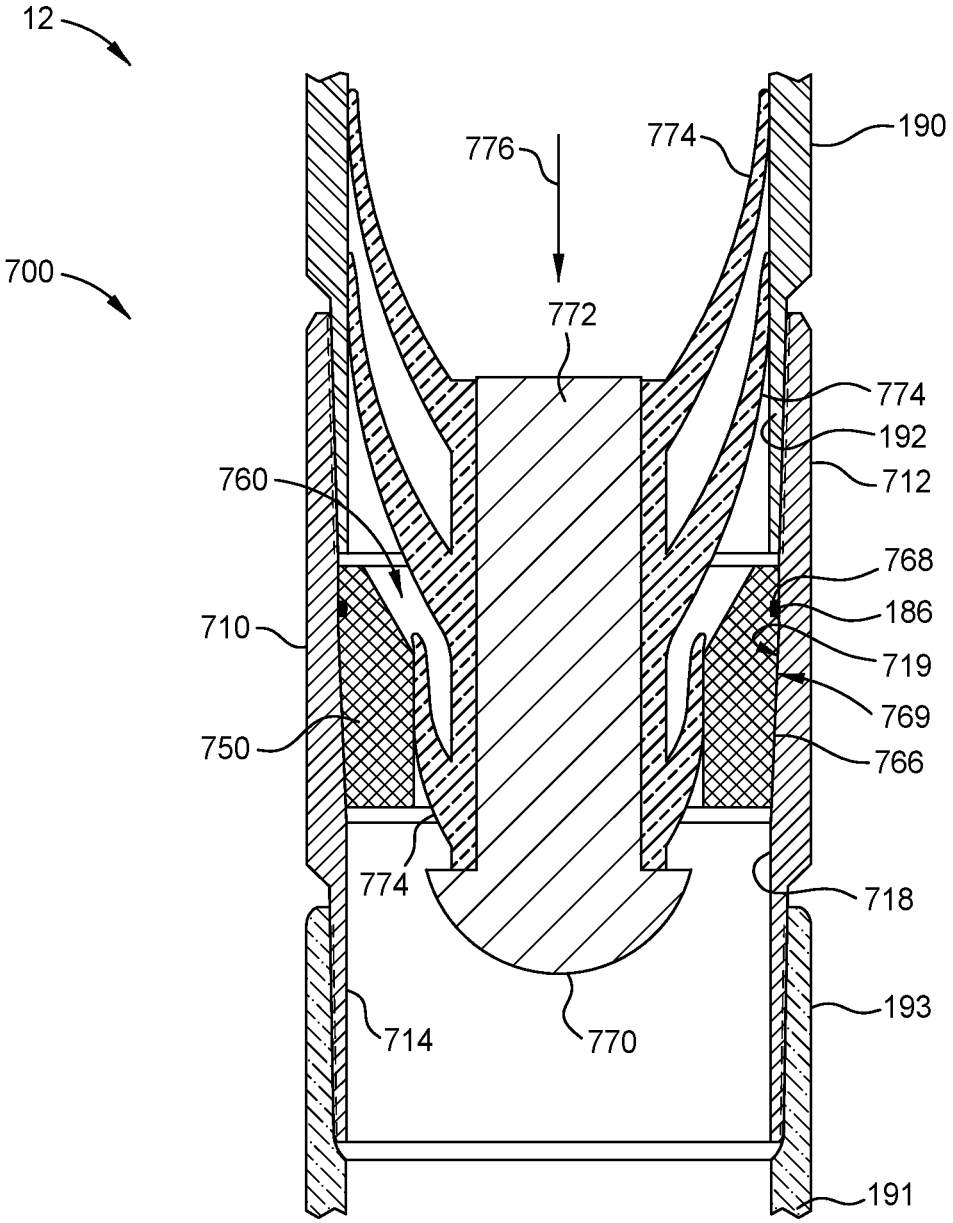
FIG. 7 is a cross-sectional view of a catcher during an exemplary operational phase.

FIG. 7 is a cross-sectional view of a catcher 700 during an exemplary operational phase. The catcher 700 represents, and thus may be, any of the first catcher 30 and/or the second catcher 40 illustrated in FIG. 1. The catcher 700 represents, and thus may be, any of the catchers 100, 200, 300, 400, 500, 600. Elements of catcher 700 that are equivalent to corresponding elements of catchers 100, 200, 300, 400, 500, 600 are numbered similarly, but starting with 700 instead of 100, 200, 300, 400, 500, 600, respectively. The catcher 700 forms part of a casing string 12, and is coupled to an adjoining item 190 via a top connector 712 being engaged with a connector 192 of the adjoining item 190. The catcher 700 is coupled to an adjoining item 191 via a bottom connector 714 being engaged with a connector 193 of the adjoining item 191. In some embodiments, bottom connector 714 may be engaged with a connector 193' of the adjoining item 191 where bottom connector 714 is configured as a box and connector 193' is configured as a pin. It is contemplated that each adjoining item 190, 191 may be a tubular, such as a joint of casing; a tool, such as packer 18 or stage tool 16; or some other item of oilfield equipment.

The catcher 700 includes a housing 710 and an insert 750 disposed in the housing 710. A sealing member, such as o-ring 186, in groove 768 of the insert 750 bears against an inner wall 718 of the housing 710 to provide a pressure seal of an interface between the housing 710 and the insert 750. At least a portion of an outer wall 766 of the insert 750 is frustoconical, and includes a taper 769 that is engaged with a corresponding frustoconical taper 719 of the inner wall 718 of the housing 710. It is contemplated that taper 769 may be configured similarly to any of the tapers or combinations of tapers 169, 269A, 269B, 369A, 369B, 469A, 469B, 569, and 669. It is contemplated that taper 719 may be configured similarly to any of the tapers or combinations of tapers 119, 219A, 219B, 319A, 3196, 419A, 419B, 519, and 619.

In an exemplary operation, an obturating object, such as plug 770, is conveyed in the direction shown by arrow 776 through the casing string 12 by gravity and/or by pumping a fluid. As illustrated, the plug 770 includes a body 772 and a plurality of fins 774, however, the plug 770 may take any one of a variety of forms. For example, the plug 770 may be a single-piece plug, such as foam plug. Upon encountering the catcher 700, the plug 770 passes through a longitudinal bore 760 of the catcher.

As illustrated, the plug 770 and the longitudinal bore 760 of the insert 750 are sized such that the plug 770 may pass through the insert. Nevertheless, the relative dimensions of the longitudinal bore 760 and the plug 770 are such that the insert 750 hinders passage of the plug 770 therethrough. It is contemplated that the fins 774 may be made from an elastomer, and therefore may be flexible, yet resilient. Thus, the fins 774 resist the deformation required for the plug 770 to fit in the longitudinal bore 760. In some embodiments, it is contemplated that the rate of passage of the plug 770 through the catcher 700 is slowed. In some embodiments, it is contemplated that the passage of the plug 770 through the catcher 700 is at least temporarily halted.

The operation includes pumping a fluid and promoting passage of the plug 770 through the catcher 700. Because passage of the plug 770 through the catcher 700 is hindered, a pumping pressure required to convey the plug 770 through the catcher 700 is greater than a pumping pressure required to convey the plug 770 through the casing string 12 prior to the plug 770 encountering the catcher 700, and greater than a pumping pressure required to convey the plug 770 through the casing string 12 upon the plug 770 exiting the catcher 700. Thus, changes in pumping pressure upon the plug 770 encountering the catcher 700, passing through the catcher 700, and exiting the catcher 700 may be observed. Such changes in pumping pressure may provide a characteristic signal of the plug 770 encountering, passing through, and/or exiting the catcher 700. Hence, an operator may determine that the plug 770 has reached a location of the casing string 12 that is specified by the presence of the catcher 700.

In some embodiments, it is contemplated that multiple catchers 700 may be included in a casing string 12, such as illustrated by catchers 30 and 40 in FIG. 1. It is further contemplated that passage of a plug 770 through the casing string 12 may be tracked by observing sequential pumping pressure characteristics that are indicative of the plug 770 encountering, passing through, and/or exiting each catcher 700. Additionally, it is contemplated that an operator may verify or adjust a planned pumping rate, planned pumping pressure, planned pumping time, and/or planned total pumping volume on the basis of observing one or more pumping pressure characteristics indicative of the plug 770 encountering, passing through, and/or exiting a catcher 700.

Figure 8:
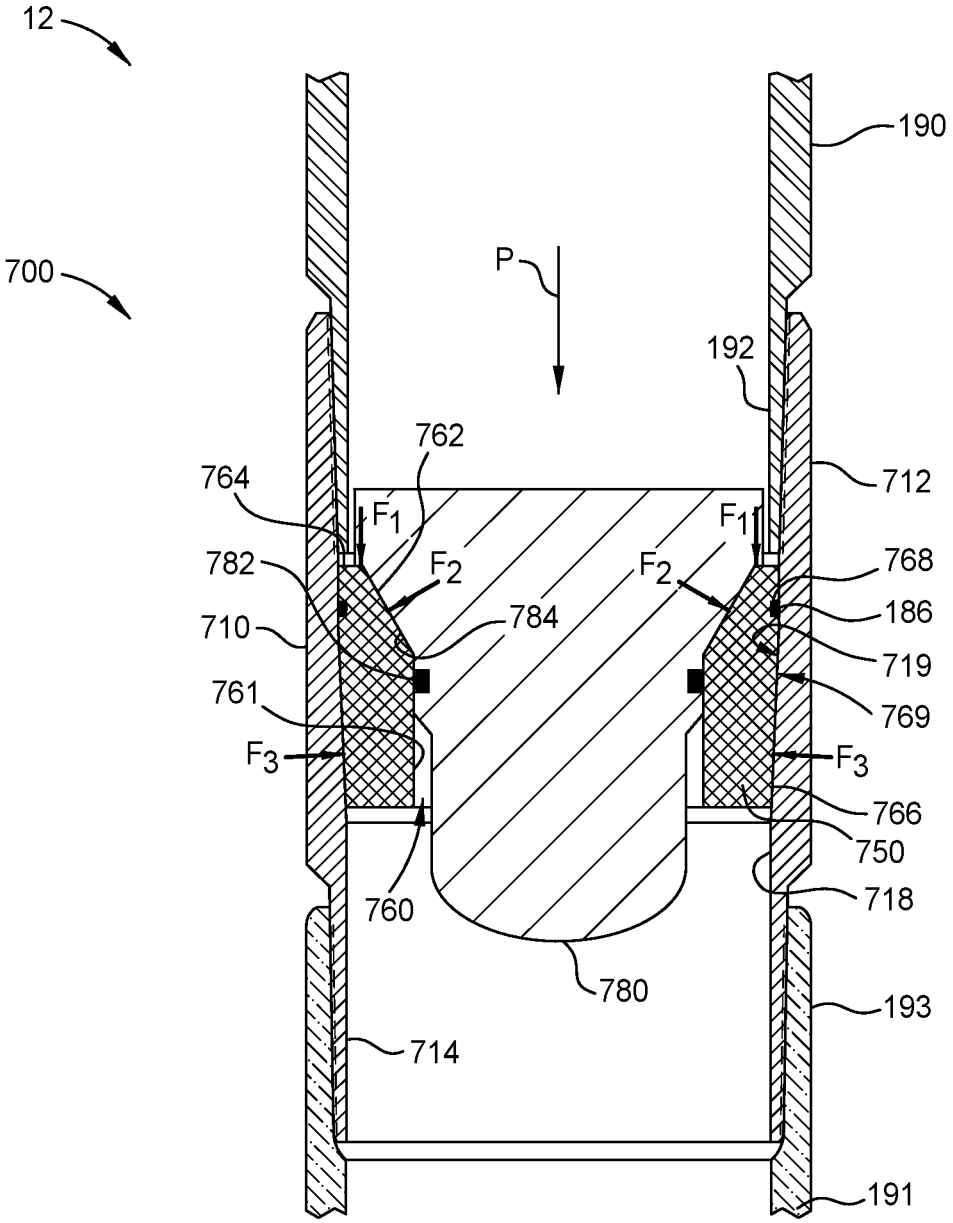
FIG. 8 is a cross-sectional view of the catcher of FIG. 7 during another exemplary operational phase.

FIG. 8 is a cross-sectional view of the catcher 700 of FIG. 7 during another exemplary operational phase. The operational phase illustrated in FIG. 8 may be additional to or instead of the operational phase depicted in FIG. 7. In an exemplary operation, an obturating object, such as cone 780, is conveyed through the casing string 12 by gravity and/or by pumping a fluid. As illustrated in FIG. 8, the cone 780 lands on the insert 750 of the catcher 700. The landed cone 780 inhibits passage of fluid through the longitudinal bore 760 of the insert 750 of the catcher 700. In some embodiments, it is contemplated that passage of fluid through the insert 750 is blocked, such as by a sealing member, such as o-ring 782, providing a pressure seal of an interface between the cone 780 and the inner wall 561 of the insert 750.

The hindrance or blocking of fluid flow through the insert 750 enables a pressure P to be applied to the cone 780. Application of pressure P to the cone 780 and insert 750 results in shoulder 764 of the insert 750 experiencing a force F1 directed towards the bottom connector 714. Force F1 thus promotes engagement of taper 769 of the insert 750 with taper 719 of housing 710. Application of pressure P to the cone 780 and insert 750 results in seat 762 of the insert 750 experiencing a force F2 where the seat 762 is engaged by seating surface 784 of the cone 780. Force F2 is directed perpendicular to the seat 762, and therefore promotes engagement of taper 769 of the insert 750 with taper 719 of housing 710. In some embodiments, it is contemplated that the obturating object may not engage the seat 762, and therefore the force F2 may be absent.

The action of force F1 and/or force F2 results in the insert 750 experiencing a force F3 where the taper 769 of the insert 750 engages the taper 719 of the housing 710. Force F3 is directed perpendicular to the taper 769. The combination of forces F1, F2 (if present), and F3 place the insert 750 under compressive loading. Hence, when the insert 750 is made of a material, such as a composite, that is strong in compression, the interaction between taper 769 and taper 719 facilitates the insert 750 being robust in operation. In some embodiments, it is contemplated that the compressive loading of insert 750 may promote taper 769 and taper 719 forming a self-locking taper connection.

Figure 9:
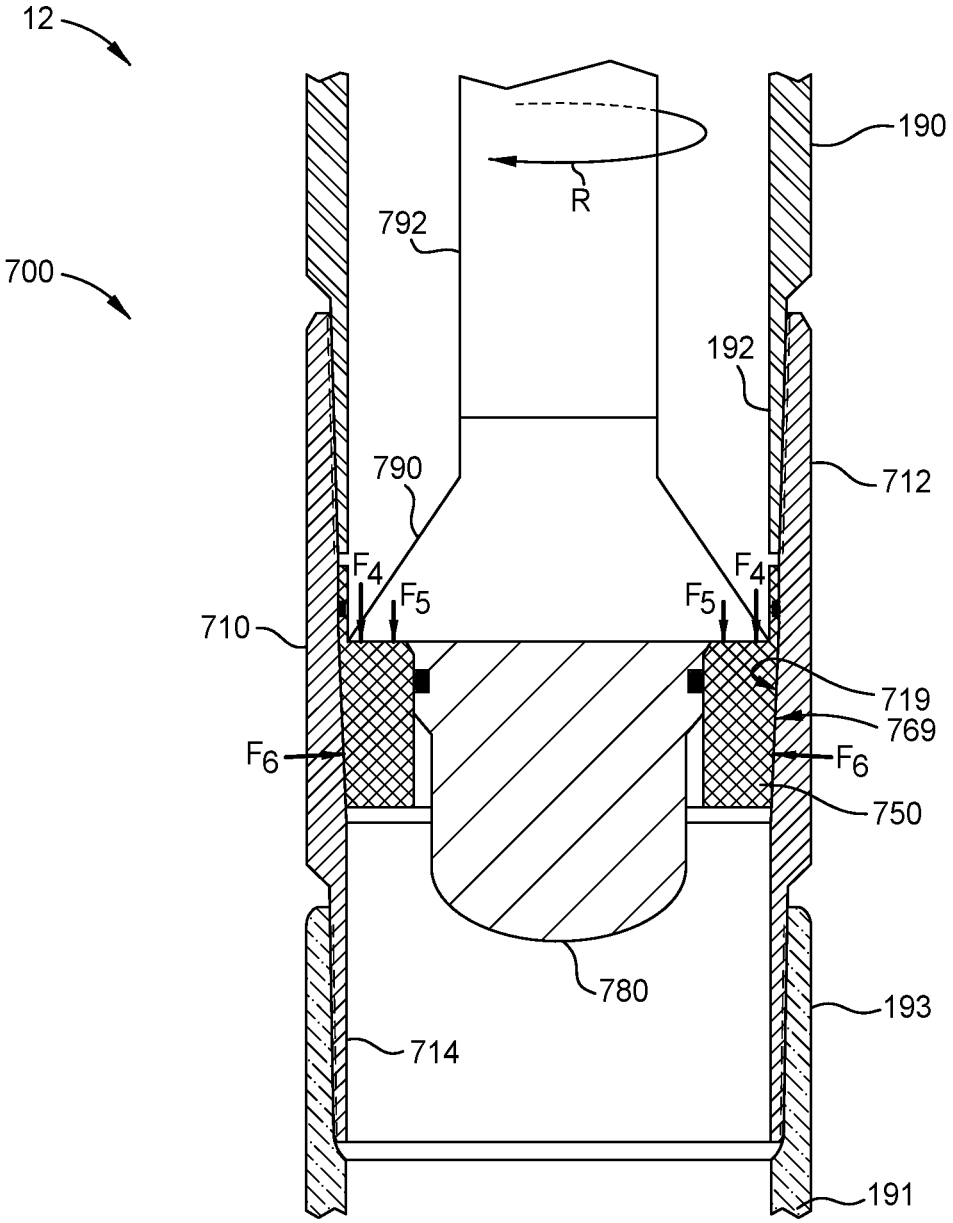
FIG. 9 is a cross-sectional view of the catcher of FIG. 7 during another exemplary operational phase.

FIG. 9 is a cross-sectional view of the catcher 700 of FIG. 7 during another exemplary operational phase. The operational phase illustrated in FIG. 9 may be additional to or instead of the operational phase depicted in FIG. 8. The operational phase illustrated in FIG. 9 may be additional to or instead of the operational phase depicted in FIG. 7. In an exemplary operation, a bit 790 is conveyed through the casing string 12 by a workstring 792. The bit 790 may be a milling tool, a drilling tool, or a combination milling and drilling tool. The bit 790 encounters the catcher 700, and disintegrates at least a portion of the insert 750 by any one or more of an impact, a crushing, a grinding, or a gouging action.

The bit 790 imparts a load on the insert 750, resulting in the insert 750 experiencing a force F4 directed towards the bottom connector 714. Force F4 thus promotes engagement of taper 769 of the insert 750 with taper 719 of housing 710. In some embodiments, it is contemplated that pressure exerted by fluid being pumped through the bit 790 during the disintegration operation may result in the insert 750 experiencing a force F5 directed towards the bottom connector 714. In some embodiments, it is contemplated that pressure exerted by fluid being pumped through the bit 790 during the disintegration operation may not result in the insert 750 experiencing a force F5 directed towards the bottom connector 714, and thus force F5 may be absent. Forces F4 and F5 (if present) thus promote engagement of taper 769 of the insert 750 with taper 719 of housing 710. The action of forces F4 and F5 (if present) results in the insert 750 experiencing a force F6 where the taper 769 of the insert 750 engages the taper 719 of the housing 710. Force F6 is directed perpendicular to the taper 769. The combination of forces F4, F5 (if present), and F6 place the insert 750 under compressive loading.

In some embodiments, it is contemplated that taper 769 and taper 719 may form a self-locking taper connection, thereby promoting the insert 750 being held rotationally stationary with respect to the housing 710. In some embodiments, it is contemplated that the engagement of taper 769 of the insert 750 with taper 719 of housing 710 under the compressive loading of insert 750 resulting from forces F4, F5 (if present), and F6 may promote the insert 750 being held rotationally stationary with respect to the housing 710. Hence, rotation (indicated by arrow R) of the bit 790 is relative to the insert 750, thereby promoting disintegration of at least a portion of the insert 750 by grinding and/or gouging by the bit 790.

In some embodiments, it is contemplated that taper 769 and taper 719 may form a self-releasing taper connection. Nevertheless, it is contemplated that application of at least one of force F4 or force F5 may promote sufficient engagement between taper 769 and taper 719 to hold the insert 750 rotationally stationary with respect to the housing 710. Hence, rotation of the bit 790 is relative to the insert 750, thereby promoting disintegration of at least a portion of the insert by grinding and/or gouging by the bit 790.

In some embodiments, it is contemplated that the insert 750 may become at least partially disintegrated as a result of an impact with the bit 790 and/or as a result of the force F4 applied by the bit 790.

It is contemplated that constructing the insert 750 out of a non-metallic material such as a plastic, a composite, a ceramic, a glass, or an organic material such as wood, facilitates the insert 750 being robust when subjected to applied pressure and/or compressive loading, yet disintegrating readily during the drilling operation described above with reference to FIG. 9. Additionally, or alternatively, in some embodiments, it is contemplated that the insert 750 may include a metal, such as aluminum, having a hardness less than that of steel. Thus, the insert 750 may be robust when subjected to applied pressure and/or compressive loading, and may offer a somewhat greater resistance to degradation by a mechanical action, yet still be readily disintegrated during the drilling operation described above with reference to FIG. 9.

In some embodiments, it is contemplated that the disintegration of at least a portion of the insert 750 may include disintegration by the bit 790 accompanied by dissolution of at least part of the insert 750. In some embodiments, it is contemplated that the disintegration of at least a portion of the insert 750 may be predominately or completely by dissolution of the insert 750, and the action of the bit 790 described above may serve to ensure or verify the disintegration of at least a portion of the insert 750.

FIG. 9 illustrates also the disintegration of at least a portion of a dropped object, such as cone 780, seated on the insert 750 in the catcher 700. In some embodiments, it is contemplated that a load applied by the bit to the cone 780 may promote the cone 780 being held rotationally stationary with respect to the insert 750. Hence, rotation R of the bit 790 may be relative to the cone 780, thereby promoting disintegration of at least a portion of the cone 780 by grinding and/or gouging by the bit 790. In some embodiments, it is contemplated that the disintegration of at least a portion of the cone 780 may include disintegration by the bit 790 accompanied by dissolution of at least part of the cone 780. In some embodiments, it is contemplated that the disintegration of at least a portion of the cone 780 may be predominately or completely by dissolution of the cone 780, and the action of the bit 790 described above may serve to ensure or verify the disintegration of at least a portion of the cone 780. In some embodiments, disintegration of the cone 780 may be at least partially achieved by the cone 780 including a mechanism that initiates the break-up of the cone 780.

Figure 10:
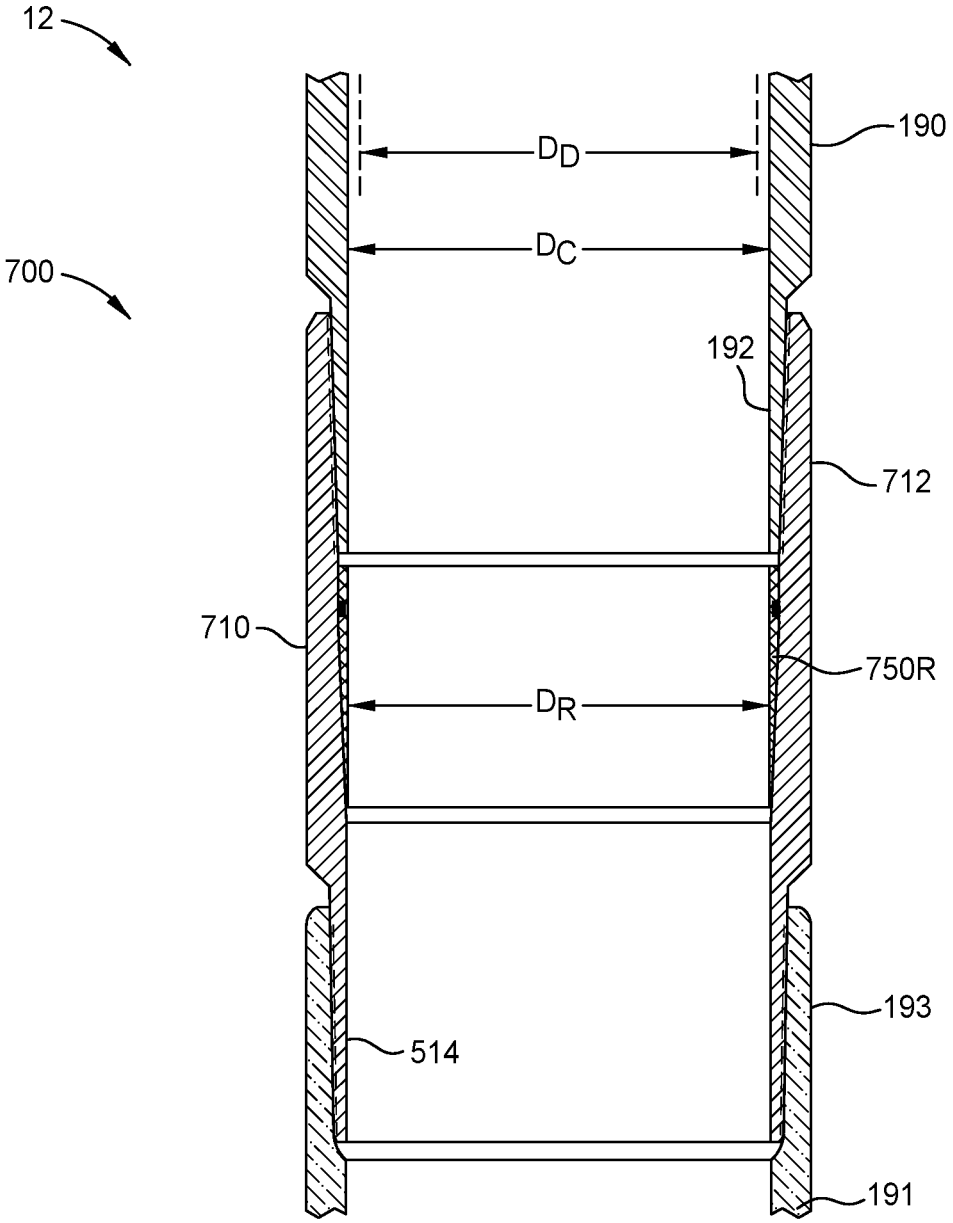
FIG. 10 is a cross-sectional view of the catcher of FIG. 7 after the operational phase depicted in FIG. 9.

FIG. 10 is a cross-sectional view of the catcher 700 of FIG. 7 after the operational phase depicted in FIG. 9. After disintegration of at least a portion of the insert 750 by the bit 790, a residue 750R may remain in the housing 710 of the catcher 700. It is contemplated that the bit 790 may be conveyed through the residue 750R, for example, in order to verify the disintegration of at least a portion of the insert 750, and/or to establish that adequate clearance through the reside 750R exists for the passage of the bit 790 and/or other tools, equipment, casing, etc. It is contemplated that an internal diameter DR of the residue 750R may be at least as great as a drift diameter Do of the casing string 12. In some embodiments, it is contemplated that the internal diameter DR of the residue 750R may be greater than the drift diameter Do of the casing string 12, and at least as great as a nominal internal diameter Dc of the casing string 12. In some embodiments, it is contemplated that the internal diameter DR of the residue 750R may be greater than the nominal internal diameter Dc of the casing string 12. In some embodiments, it is contemplated that the insert 750 may be completely removed by the disintegration action described above, and hence the residue 750R may be absent.

Figure 11:
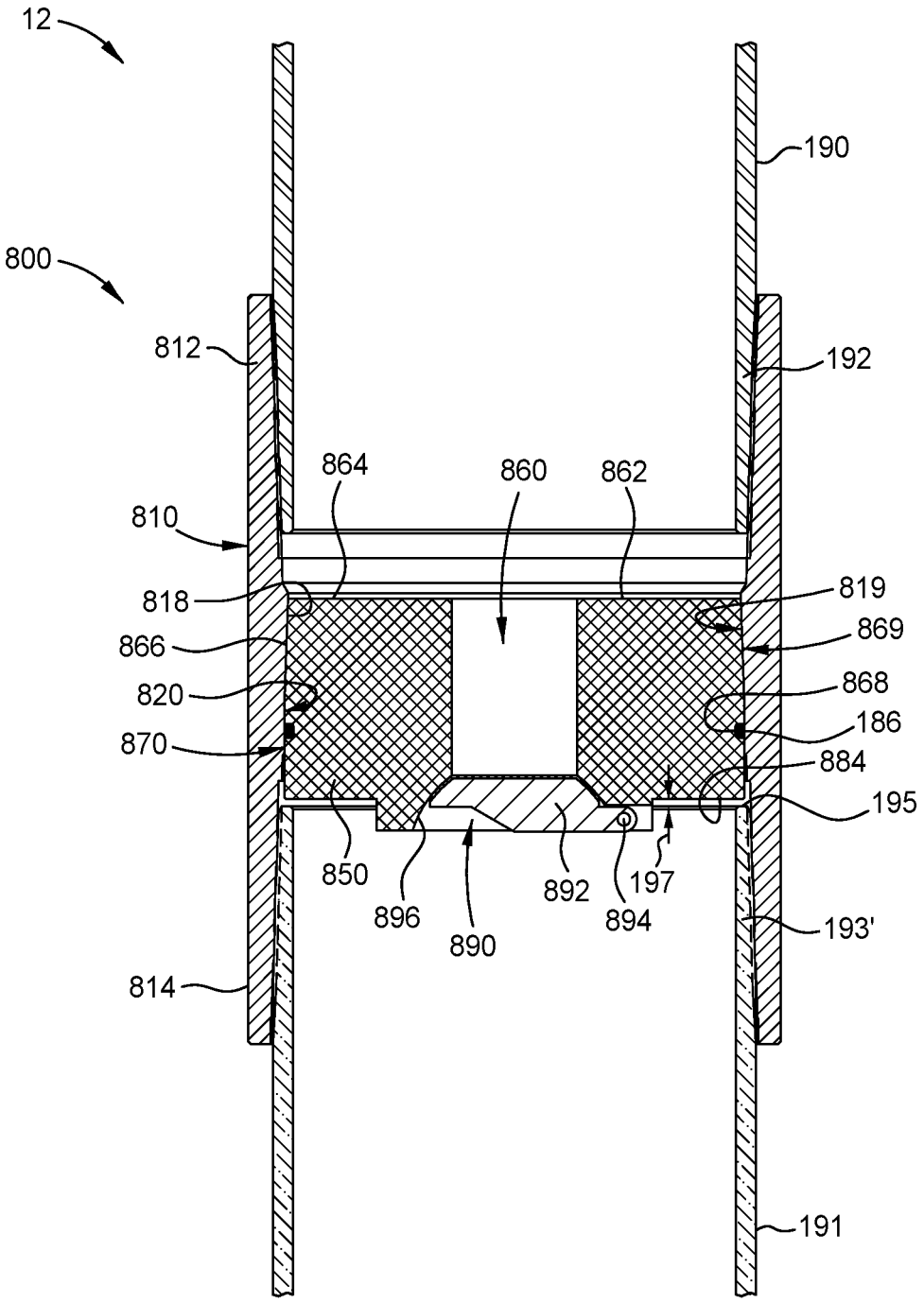
FIG. 11 is a cross-sectional view of an alternative embodiment of a catcher.

FIG. 11 is a cross-sectional view of an alternative embodiment of a catcher. Catcher 800 is configured to include a valve, such as a one-way valve, such as a float valve. Elements of catcher 800 that are equivalent to corresponding elements of catchers 100, 200, 300, 400, 500, 600, and 700 are numbered similarly, but starting with 800 instead of 100, 200, 300, 400, 500, 600, and 700, respectively. The catcher 800 is illustrated when forming part of a casing string 12, being coupled to an adjoining item 190 via a top connector 812 engaged with a connector 192 of the adjoining item 190. The catcher 800 is illustrated to be coupled to an adjoining item 191 via a bottom connector 814 engaged with a connector 193' of the adjoining item 191. As shown, the bottom connector 814 is a threaded box configured to mate with a corresponding threaded pin 193'. However, in some embodiments it is contemplated that the bottom connector 814 may be a threaded pin configured to mate with a corresponding threaded box, such as connector 193 shown in FIGS. 4A-4D. It is contemplated that each adjoining item 190, 191 may be a tubular, such as a joint of casing; a tool, such as packer 18 or stage tool 16; or some other item of oilfield equipment.

The catcher 800 includes a housing 810 and an insert 850 disposed in the housing 810. At least a portion of an outer wall 866 of the insert 850 is frustoconical, and includes a taper 869 that is engaged with a corresponding frustoconical taper 819 of the inner wall 818 of the housing 810. It is contemplated that taper 869 may be configured similarly to any of the tapers or combinations of tapers 169, 269A, 269B, 369A, 369B, 469A, 469B, 569, 669, and 769. It is contemplated that taper 819 may be configured similarly to any of the tapers or combinations of tapers 119, 219A, 219B, 319A, 319B, 419A, 419B, 519, 619, and 719. Nevertheless, in contrast to tapers 169, 269A, 269B, 369A, 369B, 469A, 469B, 569, 669, 769 and tapers, 119, 219A, 219B, 319A, 319B, 419A, 419B, 519, 619, 719, tapers 869 and 819 are inverted. Thus, taper 819 has a smallest inner diameter at a location proximate to the top connector 812, and a largest inner diameter at a location distal from the top connector 812.

Taper 869 is configured to fit with taper 819. In some embodiments, it is contemplated that the taper 869 of the outer wall 866 of the insert 850 engaged with the taper 819 of the inner wall 818 of the housing 810 forms a self-locking taper connection. In some embodiments, it is contemplated that the taper 869 of the outer wall 866 of the insert 850 engaged with the taper 819 of the inner wall 818 of the housing 810 forms a self-releasing taper connection.

The inner wall 818 of the housing 810 includes a parallel region 820 between the taper 819 and the bottom connector 814. The outer wall 866 of the insert 850 includes a corresponding parallel region 870. Hence, when the taper 869 of the insert 850 is engaged with the taper 819 of the housing 810, the parallel region 870 of the insert 850 is engaged with the parallel region 820 of the housing 810. The outer wall 866 of the insert 850 at the parallel region 870 includes a groove 868 for a seal, such as o-ring 186.

Similar to inserts 150, 250, 350, 450, 550, 650, and 750, the insert 850 has a shoulder 864 and a longitudinal bore 860. As illustrated, the shoulder 864 includes a seat 862. In some embodiments, it is contemplated that the insert 850 may include a seat 862 configured similarly to seats 162, 262, 362, 462, 562, 662, or 762. The seat 862 is configured to receive an obturating object, such as a ball, a cone, a dart, a plug, or the like. In some embodiments, it is contemplated that the obturating object may seal against the insert 850 when landed on the seat 862.

FIG. 11 illustrates a gap 197 existing between an end 195 of the connector 193' and a lower shoulder 884 of the insert 850. In some embodiments, it is contemplated that the gap 197 may be absent such that the end 195 of the connector 193' bears against the lower shoulder 884 of the insert 850.

The insert 850 has a valve 890. The valve 890 is configured to open to permit fluid flow through the insert 850 from a zone at the top connector 812 to a zone at the bottom connector 814. The valve 890 is configured to block fluid flow through the insert 850 from the zone at the bottom connector 814 to the zone at the top connector 812. As illustrated, the valve 890 includes a flapper 892 that is configured to rotate about a pivot 894 between: an open position in which the flapper 892 is away from a valve seat 896 and whereby fluid is permitted to flow through the insert 850, and a closed position in which the flapper 892 is seated on the valve seat 896 and whereby fluid flow through the insert 850 is blocked. In some embodiments, the flapper 892 may be biased towards the closed position by a spring. In some embodiments, it is contemplated that the valve 890 may be a poppet-style valve instead of a flapper-style valve.

In some embodiments, it is contemplated that the valve 890 may be assembled as an integral unit that is mated with the insert 850. For example, the flapper 892, pivot 894, and valve seat 896 may be assembled together before being installed on the insert 850, such as in a recess in the insert 850. In some embodiments, it is contemplated that the valve 890 may be partially assembled before being installed in a recess in the insert 850. For example, the flapper 892 and pivot 894 may be assembled together before being installed on the insert 850. Alternatively, the flapper 892 may be installed on the insert 850 such that the insert 850 includes at least part of the pivot 894. In such examples, the valve seat 896 may be separately installed on the insert 850 or may be formed as a surface of the insert 850.

It is contemplated that the housing 810 may be made from a material similar to any of the housings 110, 210, 310, 410, 510, 610, and 710. It is contemplated that the insert 850 may be made from a material similar to any of the inserts 150, 250, 350, 450, 550, 650, and 750. It is contemplated that the flapper 892 may be made from a plastic, an elastomer, a composite material, a metal, or any other material suited for effecting a seal against the valve seat 896 and withstanding a differential pressure such as up to 1,000 psi (68.9 bar), up to 3,000 psi (206.8 bar), up to 5,000 psi (344.7 bar), up to 10,000 psi (689.5 bar), up to 15,000 psi (1,034.2 bar), or greater.

Figure 12:
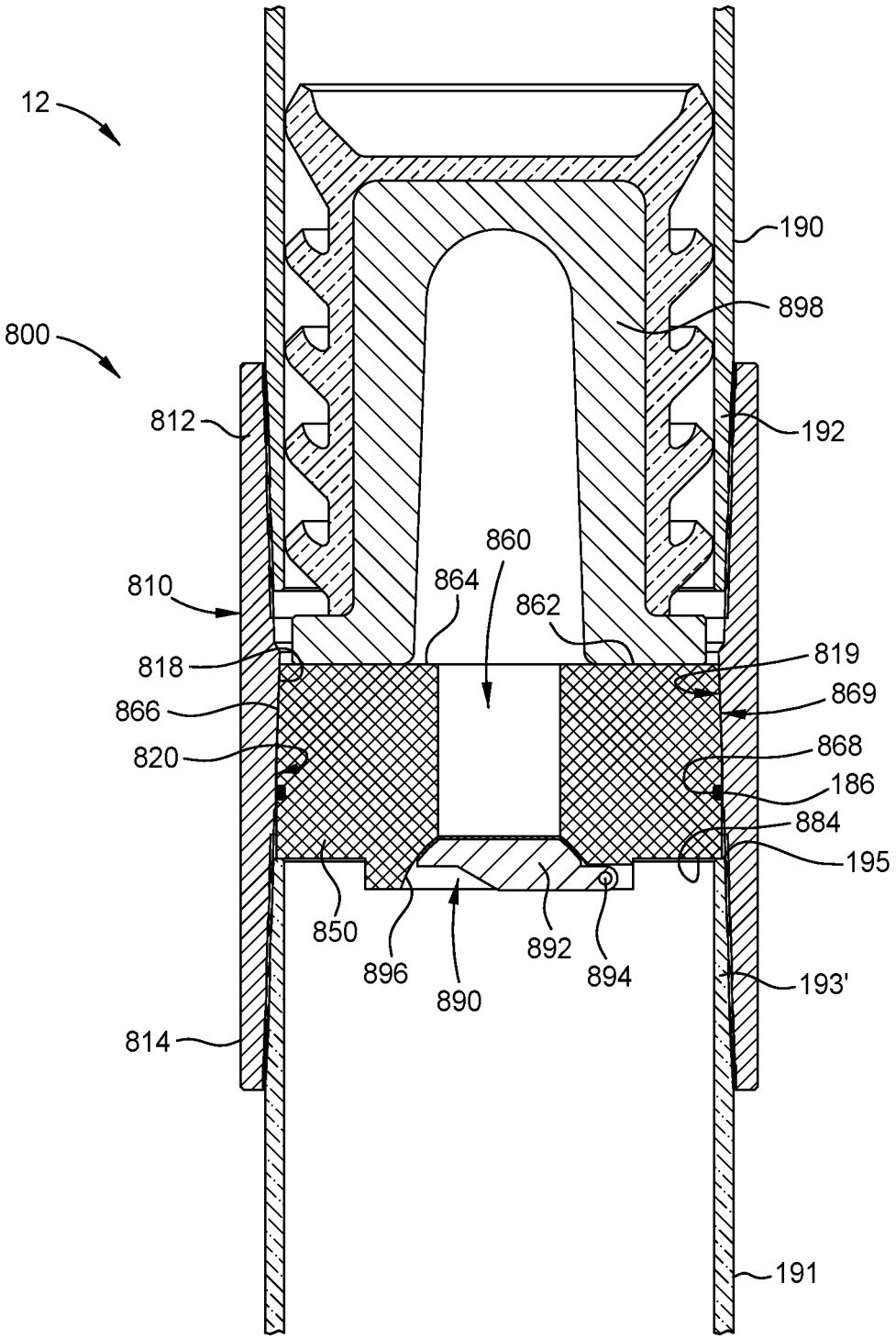
FIG. 12 is a cross-sectional view of the embodiment of a catcher of FIG. 11 during an exemplary operational phase.

FIG. 12 illustrates the catcher 800 during an exemplary operation. It is noted that FIG. 12 illustrates the valve 890 in the closed position, although the valve 890 will transition to the open position during certain operations, as described below. In use, the catcher 800 can form part of a casing string 12 and used as a cementing float collar or as part of a cementing float shoe. A cement slurry is pumped through the casing string 12. In some embodiments, a bottom cementing plug is released into the casing string 12 to separate the cement slurry from drilling fluid already present in the casing string 12, and a top cementing plug is used to separate the cement slurry from drilling fluid that is pumped into the casing string 12 after the cement slurry has been pumped into the casing string 12. In some embodiments, such as when the casing string 12 is deployed as a liner, a bottom cementing plug may be omitted. Thus, cementing plug 898 illustrated in FIG. 12 may represent a bottom cementing plug or a top cementing plug. While pumping fluid, such as the cement slurry and/or drilling fluid, through the casing string 12, the valve 890 opens, thereby permitting the fluid to flow through the insert 850 of the catcher 800 from the zone at the top connector 812 to the zone at the bottom connector 814.

In embodiments in which a bottom cementing plug is deployed, the bottom cementing plug travels through the casing string 12 and lands on the seat 862 and/or shoulder 864 of the insert 850 of the catcher 800. Continued pumping of fluid into the casing string 12 results in a portion of the bottom cementing plug rupturing, and the cement slurry flowing through the bottom cementing plug and through the insert 850. While the cement slurry flows through the bottom cementing plug and through the insert 850 of the catcher 800, the top cementing plug travels through the casing string 12 and then lands on the bottom cementing plug. At this time, flow of the cement slurry through the bottom cementing plug and through the insert 850 of the catcher 800 ceases, and the valve 890 closes.

In embodiments in which a bottom cementing plug is not deployed, cement slurry flows through the insert 850 of the catcher 800, while the top cementing plug travels through the casing string 12. The top cementing plug then lands on the seat 862 and/or shoulder 864 of the insert 850 of the catcher 800. At this time, flow of the cement slurry through the insert 850 of the catcher 800 ceases, and the valve 890 closes.

In some embodiments, it is contemplated that taper 869 and taper 819 may form a self-locking taper connection. In such embodiments, the self-locking taper connection may withstand a force applied to the insert 850, such as a force resulting from a pressure applied to the cementing plug 898. However, in some embodiments, the self-locking taper connection may not withstand a force applied to the insert 850, such as a force resulting from a pressure applied to the cementing plug 898. In embodiments in which the self-locking taper connection does not withstand a force applied to the insert 850, or the taper 869 and the taper 819 do not form a self-locking taper connection, it is contemplated that the insert 850 may move downwards within the housing 810 until the lower shoulder 884 bears against the end 195 of the connector 193', as illustrated in FIG. 12. Nevertheless, the sealing member (represented by o-ring 186) in groove 868 of the insert 850 may still effect a seal against the inner wall 818 of the housing 810 within the parallel region 820.

In some embodiments, it is contemplated that the operation may further include disintegrating at least a portion of the insert 850 by any one or more of an impact, a crushing, a grinding, or a gouging action by a tool, such as the bit 790, such as described with respect to FIG. 9. At least a portion of the valve 890 may also be disintegrated. In some embodiments, it is contemplated that the disintegration of at least a portion of the insert 850 may include disintegration by the bit 790 accompanied by dissolution of at least part of the insert 850. In some embodiments, it is contemplated that the disintegration of at least a portion of the insert 850 may be predominately or completely by dissolution of the insert 850, and the action of the bit 790 described above may serve to ensure or verify the disintegration of at least a portion of the insert 850.

In some embodiments, it is contemplated that during disintegration of at least a portion of the insert 850, the insert 850 may be supported by hardened cement below the valve 890 and/or the lower shoulder 884 bearing against the end 195 of the connector 193'. In such embodiments, it is contemplated that the insert 850 may fracture due to any one or more of an impact, a crushing, a grinding, or a gouging action by the bit 790. In some embodiments, it is contemplated that the insert 850 may not be supported by hardened cement below the valve 890, and a central portion of the insert 850 may separate from a peripheral portion of the insert 850. Hence, a residue portion similar to residue 750R, although inverted, may remain in the housing 810. Alternatively, in some embodiments, no residue portion may remain in the housing 810.

Figure 13:
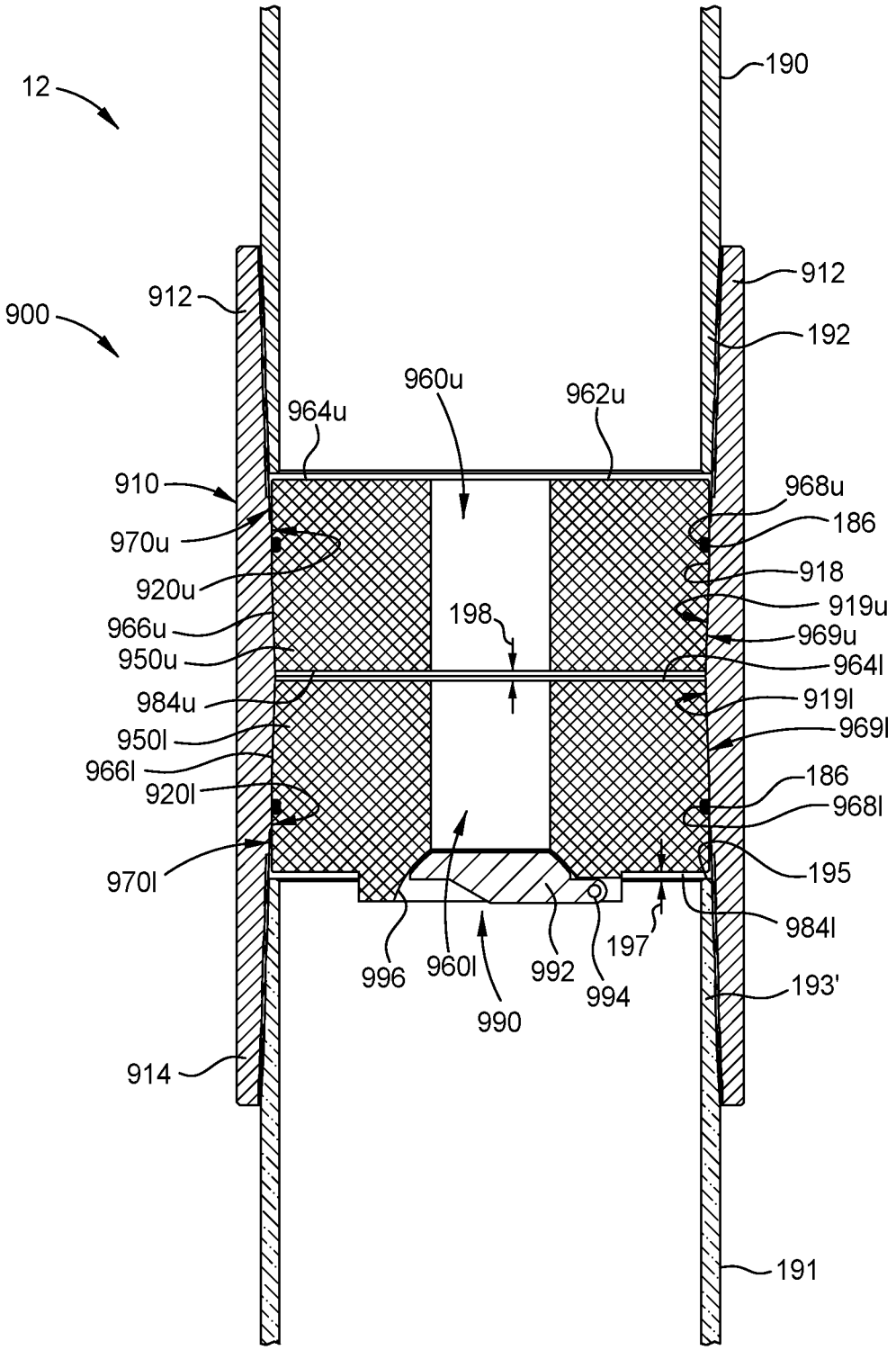
FIG. 13 is a cross-sectional view of an alternative embodiment of a catcher.

FIG. 13 is a cross-sectional view of an alternative embodiment of a catcher. Catcher 900 is configured to include a valve, such as a one-way valve, such as a float valve. Elements of catcher 900 that are equivalent to corresponding elements of catchers 100, 200, 300, 400, 500, 600, 700, and 800 are numbered similarly, but starting with 900 instead of 100, 200, 300, 400, 500, 600, 700, 800 respectively. The catcher 900 is illustrated when forming part of a casing string 12, being coupled to an adjoining item 190 via a top connector 912 engaged with a connector 192 of the adjoining item 190. The catcher 900 is illustrated to be coupled to an adjoining item 191 via a bottom connector 914 engaged with a connector 193' of the adjoining item 191. As shown, the bottom connector 914 is a threaded box configured to mate with a corresponding threaded pin 193'. However, in some embodiments it is contemplated that the bottom connector 914 may be a threaded pin configured to mate with a corresponding threaded box, such as connector 193 shown in FIGS. 4A-4D. It is contemplated that each adjoining item 190, 191 may be a tubular, such as a joint of casing; a tool, such as packer 18 or stage tool 16; or some other item of oilfield equipment.

The catcher 900 includes a housing 910 and two inserts, an upper insert 950*u* and a lower insert 950*l*, disposed in the housing 910. At least a portion of an outer wall 966*u* of the upper insert 950*u* is frustoconical, and includes a taper 969*u* that is engaged with a corresponding frustoconical taper 919*u* of the inner wall 918 of the housing 910. It is contemplated that taper 969*u* may be configured similarly to any of the tapers or combinations of tapers 169, 269A, 269B, 369A, 369B, 469A, 469B, 569, 669, and 769. It is contemplated that taper 919*u* may be configured similarly to any of the tapers or combinations of tapers 119, 219A, 219B, 319A, 319B, 419A, 419B, 519, 619, and 719.

Taper 969*u* is configured to fit with taper 919*u*. In some embodiments, it is contemplated that the taper 969*u* of the outer wall 966*u* of the insert 950*u* engaged with the taper 919*u* of the inner wall 918 of the housing 910 forms a self-locking taper connection. In some embodiments, it is contemplated that the taper 969*u* of the outer wall 966*u* of the insert 950*u* engaged with the taper 919*u* of the inner wall 918 of the housing 910 forms a self-releasing taper connection.

The inner wall 918 of the housing 910 includes a parallel region 920*u* between the taper 919*u* and the top connector 912. The outer wall 966*u* of the upper insert 950*u* includes a corresponding parallel region 970*u*. Hence, when the taper 969*u* of the upper insert 950*u* is engaged with the taper 919*u* of the housing 910, the parallel region 970*u* of the upper insert 950*u* is engaged with the parallel region 920*u* of the housing 910. The outer wall 966*u* of the upper insert 950*u* at the parallel region 970*u* includes a groove 968*u* for a seal, such as o-ring 186.

Similar to inserts 150, 250, 350, 450, 550, 650, 750, and 850, the upper insert 950*u* has a shoulder 964*u* and a longitudinal bore 960*u*. As illustrated, the shoulder 964*u* includes a seat 962*u*. In some embodiments, it is contemplated that the upper insert 950*u* may include a seat 962*u* configured similarly to seats 162, 262, 362, 462, 562, 662, or 762. The seat 962*u* is configured to receive an obturating object, such as a ball, a cone, a dart, a plug, or the like. In some embodiments, it is contemplated that the obturating object may seal against the upper insert 950*u* when landed on the seat 962*u*.

At least a portion of an outer wall 9661 of the lower insert 950*l* is frustoconical, and includes a taper 969*l* that is engaged with a corresponding frustoconical taper 919*l* of the inner wall 918 of the housing 910. It is contemplated that taper 969*l* may be configured similarly to the taper 869. It is contemplated that taper 919*l* may be configured similarly to the taper 819. Thus, in contrast to tapers 169, 269A, 269B, 369A, 369B, 469A, 469B, 569, 669 and tapers, 119, 219A, 219B, 319A, 319B, 419A, 419B, 519, 619, tapers 9691 and 9191 are inverted. Hence, taper 919*l* has a smallest inner diameter at a location distal from the bottom connector 914, and a largest inner diameter at a location proximate to the bottom connector 914.

Taper 969*l* is configured to fit with taper 919*l*. In some embodiments, it is contemplated that the taper 969*l* of the outer wall 9661 of the insert 950*u* engaged with the taper 919*l* of the inner wall 918 of the housing 910 forms a self-locking taper connection. In some embodiments, it is contemplated that the taper 969*l* of the outer wall 9661 of the insert 950*l* engaged with the taper 919*l* of the inner wall 918 of the housing 910 forms a self-releasing taper connection.

The inner wall 918 of the housing 910 includes a parallel region 9201 between the taper 919*l* and the bottom connector 914. The outer wall 9661 of the lower insert 950*l* includes a corresponding parallel region 9701. Hence, when the taper 969*l* of the lower insert 950*l* is engaged with the taper 919*l* of the housing 910, the parallel region 970*l* of the lower insert 950*l* is engaged with the parallel region 920*l* of the housing 910. The outer wall 966*l* of the lower insert 950*l* at the parallel region 970*l* includes a groove 9681 for a seal, such as o-ring 186.

Similar to inserts 150, 250, 350, 450, 550, 650, 750, and 850, the lower insert 950*l* has a shoulder 9641 and a longitudinal bore 9601. In some embodiments, it is contemplated that the lower insert 950*l* may include a seat configured similarly to seats 162, 262, 362, 462, 562, 662, 762, or 862.

FIG. 13 illustrates a gap 198 existing between the shoulder 9641 of the lower insert 950*l* and a lower shoulder 984*u* of the upper insert 950*u*. In some embodiments, it is contemplated that the gap 198 may be absent such that the shoulder 964*l* of the lower insert 950*l* bears against the lower shoulder 984*u* of the upper insert 950*u*. FIG. 13 illustrates a gap 197 existing between an end 195 of the connector 193' and a lower shoulder 9841 of the lower insert 950*l*. In some embodiments, it is contemplated that the gap 197 may be absent such that the end 195 of the connector 193' bears against the lower shoulder 9841 of the lower insert 950*l*.

The lower insert 950*l* has a valve 990. The valve 990 is configured to open to permit fluid flow through the lower insert 950*l* from a zone at the top connector 912 to a zone at the bottom connector 914. The valve 990 is configured to block fluid flow through the lower insert 950*l* from the zone at the bottom connector 914 to the zone at the top connector 912. As illustrated, the valve 990 includes a flapper 992 that is configured to rotate about a pivot 994 between: an open position in which the flapper 992 is away from a valve seat 996 and whereby fluid is permitted to flow through the lower insert 950*l*, and a closed position in which the flapper 992 is seated on the valve seat 996 and whereby fluid flow through the lower insert 950*l* is blocked. In some embodiments, the flapper 992 may be biased towards the closed position by a spring. In some embodiments, it is contemplated that the valve 990 may be a poppet-style valve instead of a flapper-style valve.

In some embodiments, it is contemplated that the valve 990 may be assembled as an integral unit that is mated with the lower insert 950*l*. For example, the flapper 992, pivot 994, and valve seat 996 may be assembled together before being installed on the lower insert 950*l*, such as in a recess in the lower insert 950*l*. In some embodiments, it is contemplated that the valve 990 may be partially assembled before being installed in a recess in the lower insert 950*l*. For example, the flapper 992 and pivot 994 may be assembled together before being installed on the lower insert 950*l*. Alternatively, the flapper 992 may be installed on the lower insert 950*l* such that the lower insert 950*l* includes at least part of the pivot 994. In such examples, the valve seat 996 may be separately installed on the lower insert 950*l* or may be formed as a surface of the lower insert 950*l*.

It is contemplated that the housing 910 may be made from a material similar to any of the housings 110, 210, 310, 410, 510, 610, 710, and 810. It is contemplated that the upper insert 950*u* and the lower insert 950*l* may be made from a material similar to any of the inserts 150, 250, 350, 450, 550, 650, 750, and 850. It is contemplated that the flapper 992 may be made from a plastic, an elastomer, a composite material, a metal, or any other material suited for effecting a seal against the valve seat 996 and withstanding a differential pressure such as up to 1,000 psi (68.9 bar), up to 3,000 psi (206.8 bar), up to 5,000 psi (344.7 bar), up to 10,000 psi (689.5 bar), up to 15,000 psi (1,034.2 bar), or greater.

Figure 14:
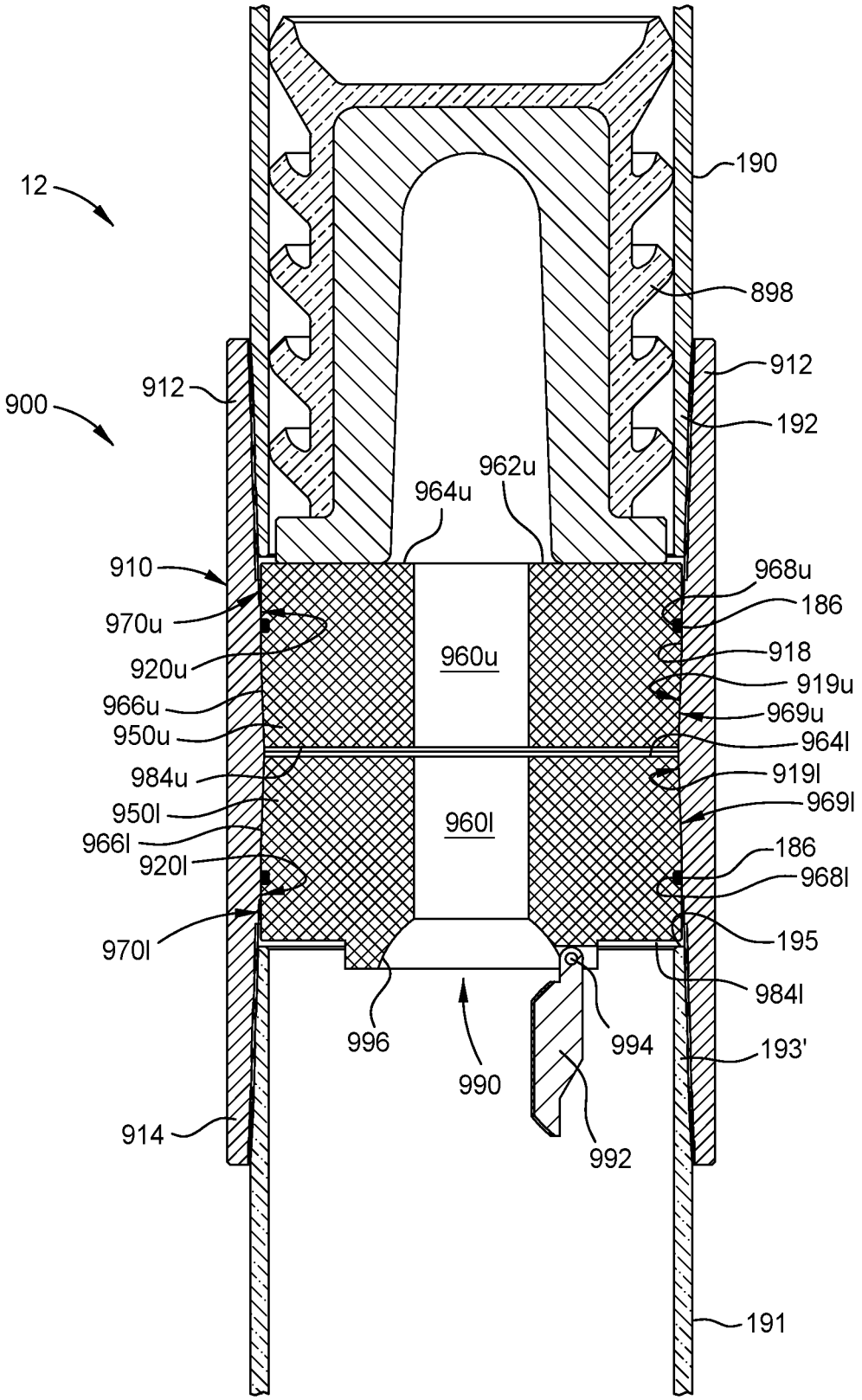
FIG. 14 is a cross-sectional view of the embodiment of a catcher of FIG. 13 during an exemplary operational phase.

FIG. 14 illustrates the catcher 900 during an exemplary operation. In use, the catcher 900 can form part of a casing string 12 and used as a cementing float collar or as part of a cementing float shoe. A cementing operation involving the catcher 900 includes the actions as described above with respect to FIG. 12 and catcher 800. It is noted, however, that the cementing operation involving the catcher 900 includes the cementing plug 898 landing on the upper insert 950*u*. Thus, the lower insert 950*l* is shielded from any force applied from the cementing plug 898. It is further noted that FIG. 14 illustrates the valve 990 in the open position, although the valve 990 will transition to the closed position during certain operations, as described above concerning the valve 890 with respect to FIG. 12.

In some embodiments, it is contemplated that the operation described above involving the catcher 900, including incorporation by reference of equivalent cementing operations involving the catcher 800, may further include disintegrating at least a portion of the upper insert 950*u* by any one or more of an impact, a crushing, a grinding, or a gouging action by the bit 790, such as described with respect to FIG. 9. Additionally, the operation may further include disintegrating at least a portion of the lower insert 950*l* by any one or more of an impact, a crushing, a grinding, or a gouging action by the bit 790, such as described with respect to FIG. 9.

At least a portion of the valve 990 may also be disintegrated. In some embodiments, it is contemplated that the disintegration of at least a portion of the upper insert 950*u* and/or the lower insert 950*l* may include disintegration by the bit 790 accompanied by dissolution of at least part of the upper insert 950*u* and/or the lower insert 950*l*. In some embodiments, it is contemplated that the disintegration of at least a portion of the upper insert 950*u* and/or the lower insert 950*l* may be predominately or completely by dissolution of the upper insert 950*u* and/or the lower insert 950*l*, and the action of the bit 790 described above may serve to ensure or verify the disintegration of at least a portion of the upper insert 950*u* and/or the lower insert 950*l*.

In some embodiments, it is contemplated that the disintegration of at least a portion of the upper insert 950*u* may proceed similarly to the disintegration of at least a portion of the insert 750 of the catcher 700, as described above with respect to FIGS. 9 and 10. Hence, following disintegration of at least a portion of the upper insert 950*u*, a residue portion similar to residue 750R may remain.

In some embodiments, it is contemplated that the disintegration of at least a portion of the lower insert 950*l* may proceed similarly to the disintegration of at least a portion of the insert 850 of the catcher 800, as described above. Hence, in some embodiments, following disintegration of at least a portion of the lower insert 950*l*, a residue portion similar to residue 750R, although inverted, may remain in the housing 910. Alternatively, in some embodiments, no residue portion may remain in the housing 910.

Embodiments of present disclosure provide a catcher for use in a wellbore. The catcher includes a housing having an inner wall with a taper. The catcher further includes an insert having an outer wall with a taper that is engaged with the taper of the inner wall of the housing. The insert is robust when subjected to applied pressure and/or compressive loading. The interaction between the taper of the inner wall of the housing and the taper of the outer wall of the insert holds the insert rotationally stationary with respect to the housing. The insert is made from a material that readily disintegrates when subjected to a drilling and/or dissolution operation. In embodiments in which the insert is made from a non-metallic material, such as a plastic, a composite, a ceramic, a glass, or an organic material such as wood, the catcher incorporating such an insert may be less expensive than an equivalent catcher having an insert made from a metal.

While the foregoing is directed to embodiments of the present disclosure, other and further embodiments of the disclosure may be devised without departing from the basic scope thereof, and the scope thereof is determined by the claims that follow.

What is claimed is:

1. A catcher for use on a work string in a wellbore, the catcher comprising:

a housing having an upper end attachable to a first tubular member of a work string, a lower end attachable to a second tubular member of the work string, a housing outer wall of fixed diameter, and a housing inner wall defining a longitudinal bore, the housing inner wall having a first taper; and an insert disposed within the housing, the insert having: an upper end; a lower end; an insert inner wall defining a longitudinal bore extending from the upper end to the lower end; a seat for catching an object dropped or pumped into the housing; and an insert outer wall having a second taper engaging the first taper, and wherein the second taper engaged with the first taper forms a self-locking taper connection.

2. The catcher of claim 1, wherein the housing is made from metal, and the insert is made from a non-metallic material.

3. The catcher of claim 1, wherein:

the first taper includes a first taper portion and a second taper portion; the second taper portion is located between the first taper portion and the lower end of the housing; and the first taper portion defines a first angle with respect to a longitudinal axis of the housing, the second taper portion defines a second angle with respect to the longitudinal axis of the housing, and the first angle is different from the second angle.

4. The catcher of claim 3, wherein:

the second taper includes a first taper portion and a second taper portion;

the second taper portion of the second taper is located between the first taper portion of the second taper and the lower end of the insert; and the first taper portion of the second taper defines a first angle with respect to a longitudinal axis of the insert, the second taper portion of the second taper defines a second angle with respect to the longitudinal axis of the insert, and the first angle is different from the second angle.

5. The catcher of claim 4, wherein the first taper portion of the first taper is engaged with the first taper portion of the second taper to form the self-locking taper connection.

6. The catcher of claim 4, wherein the second taper portion of the first taper is engaged with the second taper portion of the second taper to form the self-locking taper connection.

7. The catcher of claim 1, wherein:

the inner wall of the housing further includes a first section oriented parallel to a longitudinal axis of the housing;

the outer wall of the insert further includes a second section oriented parallel to a longitudinal axis of the insert; and the first section is juxtaposed with the second section.

8. The catcher of claim 7, further comprising a sealing member at an interface between the first section and the second section.

9. A catcher for use in a work string in a wellbore, the catcher comprising:

a metallic housing having an outer wall of fixed diameter, an inner wall including a first taper, the inner wall defining a longitudinal bore extending through the housing; and a non-metallic insert disposed within the longitudinal bore of the housing, the insert having an inner wall defining a longitudinal bore extending through the insert, and an outer wall including a second taper engaged with the first taper of the inner wall of the housing, wherein the second taper engaged with the first taper forms a self-locking taper connection.

10. The catcher of claim 9, wherein:

the inner wall of the housing further includes a first section oriented parallel to a longitudinal axis of the housing;

the outer wall of the insert further includes a second section oriented parallel to a longitudinal axis of the insert; and the first section is juxtaposed with the second section.

11. The catcher of claim 10, further comprising a sealing member at an interface between the first section and the second section.

12. The catcher of claim 9, wherein the self-locking taper connection inhibits relative rotation of the insert with respect to the housing about the longitudinal axis of the insert.

13. A method of using a catcher in a work string in a wellbore, the method comprising:

disintegrating at least a first portion of a non-metallic first insert of a first catcher, the first insert defining a longitudinal bore therethrough, the first insert positioned within a longitudinal bore of a metallic first housing of the first catcher while the first insert is held rotationally stationary with respect to the first housing by a self-locking taper connection formed between a tapered outer wall of the first insert and a cooperating tapered inner wall of the first housing, and wherein the self-locking taper connection inhibits relative rotation of the insert with respect to the housing about a longitudinal axis of the insert.

14. The method of claim 13, wherein:

the disintegrating at least a first portion of the first insert comprises rotating a bit relative to the first insert; and after the first portion has been disintegrated, conveying the bit through a residue second of the insert remaining in the first housing.

15. The method of claim 14, wherein an obturating object is landed on a seat of the first insert, and the method further comprises disintegrating at least a portion of the obturating object.

16. The method of claim 13, further comprising:

prior to disintegrating at least a portion of the first insert:

releasing an obturating object into the wellbore; and conveying the obturating object through the longitudinal bore of the first insert by pumping a fluid into the wellbore;

wherein the first insert hinders passage of the obturating object through the longitudinal bore thereof, thereby providing a first characteristic pressure signal.

17. The method of claim 16, further comprising:

conveying the obturating object through a longitudinal bore of a second insert of a second catcher;

wherein the second insert hinders passage of the obturating object through the longitudinal bore thereof, thereby providing a second characteristic pressure signal.

* * * * *